US007645019B2

(12) United States Patent
Hirakawa

(10) Patent No.: US 7,645,019 B2
(45) Date of Patent: Jan. 12, 2010

(54) IMAGE FORMING METHOD AND IMAGE FORMING APPARATUS USING TREATMENT LIQUID

(75) Inventor: Takashi Hirakawa, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 117 days.

(21) Appl. No.: 11/520,771

(22) Filed: Sep. 14, 2006

(65) Prior Publication Data

US 2007/0064026 A1 Mar. 22, 2007

(30) Foreign Application Priority Data

Sep. 16, 2005 (JP) ..... 2005-270725

(51) Int. Cl.
*B41J 2/015* (2006.01)

(52) U.S. Cl. ..... 347/21; 347/22; 347/98; 347/9

(58) Field of Classification Search ..... 347/21
See application file for complete search history.

(56) References Cited

U.S. PATENT DOCUMENTS 5,864,350 A * 1/1999 Shioya et al. ..... 347/40
5,959,641 A 9/1999 Yokoi
6,158,834 A * 12/2000 Kato et al. ..... 347/9
7,210,753 B2 * 5/2007 Couwenhove et al. ..... 347/6
2005/0083363 A1 4/2005 Ishikawa et al.

FOREIGN PATENT DOCUMENTS

JP 8-72229 A 3/1996
JP 2005-119115 A 5/2005

* cited by examiner

*Primary Examiner*—Matthew Luu
*Assistant Examiner*—Brian J Goldberg
(74) *Attorney, Agent, or Firm*—Birch, Stewart, Kolasch & Birch, LLP

(57) ABSTRACT

The image forming apparatus comprises: an object liquid deposition device which deposits an object liquid containing coloring material onto a recording medium; a treatment liquid deposition device which deposits a treatment liquid that insolubilizes the coloring material onto the recording medium; and a control device which controls the treatment liquid deposition device in such a manner that volume of the treatment liquid deposited in a high-density region on the recording medium where volume per prescribed surface area of the object liquid deposited on the recording medium is high, is less than volume of the treatment liquid deposited in a low-density region on the recording medium where the volume per prescribed surface area of the object liquid deposited on the recording medium is low.

7 Claims, 20 Drawing Sheets

FIG.14

| | LOW-DENSITY REGION DOT DIAMETER | HIGH-DENSITY REGION DOT DIAMETER | LOW-DENSITY REGION GRANULARITY | MEDIUM-DENSITY REGION GRANULARITY | HIGH-DENSITY REGION DENSITY | HIGH-DENSITY REGION LANDING INTERFERENCE |
|---|---|---|---|---|---|---|
| EMBODIMENT 1 (LOW-SPEED MODE) | SMALL | LARGE | A | C | A | F |
| EMBODIMENT 2 (HIGH-SPEED HIGH-QUALITY MODE) | SMALL | LARGE | A | B | B | B |
| EMBODIMENT 3 (HIGH-SPEED MODE) | SMALL | LARGE | A | C | B | B |
| RELATED ART EXAMPLE 1 | MEDIUM | MEDIUM | C | C | C | B |
| RELATED ART EXAMPLE 2 | LARGE | LARGE | F | F | A | F |

IMAGE FORMING METHOD AND IMAGE FORMING APPARATUS USING TREATMENT LIQUID

BACKGROUND OF THE INVENTION

1. Field of the Invention

The present invention relates to an image forming method and an image forming apparatus, and more particularly, to technology for insolubilizing the coloring material contained in an object liquid, such as ink, by means of a prescribed treatment liquid.

2. Description of the Related Art

In recent years, inkjet recording apparatuses (inkjet printers) have become widespread as image forming apparatuses for printing images. An inkjet recording apparatus prints a desired image by ejecting ink droplets from an inkjet recording head, onto a recording medium, such as recording paper, while moving the recording medium and the inkjet recording head relatively with respect to each other.

In an inkjet recording apparatus, in order to avoid bleeding and obtain a clean image, desirably, the coloring material contained in the ink is fixed rapidly onto the recording medium. In view of these circumstances, various technologies have been proposed for rapidly fixing the coloring material onto the recording medium, by insolubilizing the coloring material in ink deposited onto the recording medium by means of a prescribed treatment liquid.

Japanese Patent Application Publication No. 2005-119115 discloses an inkjet recording apparatus in which the deposition volume of a reactive liquid per unit surface area of a recording medium is varied in accordance with the differential between the landing times of the reactive liquid and the ink on the recording medium, and the reactive volume of the reactive liquid and the reactive volume of the colored ink are set to be approximately the same. Japanese Patent Application Publication No. 8-72229 discloses an inkjet recording apparatus in which a low-resolution mode using ink only, and a high-resolution mode using ink and treatment liquid are used.

In an image forming apparatus such as an inkjet recording apparatus, desirably, the diameter of the dots formed on the recording medium by the ink droplets is adjusted in accordance with the desired density. For example, in a high-density region, in order to form an image of high density, it is desirable to prevent the appearance of white background color by increasing the dot diameter. On the other hand, in a low-density region, it is desirable to improve the image granularity by making the dot diameter sufficiently small.

However, in the inkjet recording apparatus according to Japanese Patent Application Publication No. 2005-119115, since the reactive volume of the reaction liquid and the reactive volume of the colored ink are approximately the same, then the diameter of the ink dots is virtually uniform. Consequently, it is difficult to actively change the ink dot diameter. If the dot diameter is made relatively small, for example, then in the high-density region, it is difficult to make mutually adjacent ink dots contact each other, thus making white background color liable to appear. On the other hand, if the ink dot diameter is made relatively large, then it is difficult to ensure good image granularity. In this way, in the inkjet recording apparatus described in Japanese Patent Application Publication No. 2005-119115, it is difficult to satisfy both "improvement in the image granularity in the low-density region" and "prevention of the appearance of white background color in the high-density region", in an efficient manner.

Furthermore, the inkjet recording apparatus according to Japanese Patent Application Publication No. 8-72229 is disadvantageous in terms of the "improving the granularity of the image in the low-density region", since the treatment liquid is not used in low-resolution mode, and therefore, it is difficult to make the dot diameter sufficiently small. On the other hand, in the high-resolution mode, a fixed volume of the treatment liquid is used and the dot diameter may be made too small, which is disadvantageous in terms of the "preventing the occurrence of background white color in the high-density region".

Therefore, the technology for achieving both the "improvement of image granularity in the low-density region" and the "preventing the occurrence of background white color in the high-density region", in an efficient manner, have been expected.

SUMMARY OF THE INVENTION

The present invention has been contrived in view of the aforementioned circumstances, an object thereof being to provide an image forming method and an image forming apparatus to achieve a dot diameter suited to a desired image density and provide an image with high quality in both the low-density region and the high-density region.

One aspect of the present invention for achieving the aforementioned object is directed to an image forming apparatus, comprising: an object liquid deposition device which deposits an object liquid containing coloring material onto a recording medium; a treatment liquid deposition device which deposits a treatment liquid that insolubilizes the coloring material onto the recording medium; and a control device which controls the treatment liquid deposition device in such a manner that volume of the treatment liquid deposited in a high-density region on the recording medium where volume per prescribed surface area of the object liquid deposited on the recording medium is high, is less than volume of the treatment liquid deposited in a low-density region on the recording medium where the volume per prescribed surface area of the object liquid deposited on the recording medium is low.

According to this aspect of the present invention, the deposition volume of the treatment liquid in the high-density region on the recording medium is less than the deposition volume of the treatment liquid in the low-density region. Consequently, in the low-density region, since a large volume of treatment liquid is deposited with respect to the deposition volume of the object liquid, then the insolubilization of the coloring material of the object liquid is promoted, and the dot diameter of the object liquid (coloring material) on the recording medium can be made small. Furthermore, in a high-density region, since a small volume of treatment liquid is deposited with respect to the deposition volume of the object liquid, then the coloring material in the object liquid disperses and the dot diameter of the object liquid (coloring material) on the recording medium can be made large.

The term "object liquid" indicates all types of liquids containing coloring material, and for example includes ink. Furthermore, in cases where ink is used as the object liquid, for example, "insolubilization" includes a phenomenon whereby the coloring material in the ink leaves a state where it is dissolved or dispersed in the solvent of the liquid due to the action of the treatment liquid on the ink, thereby causing the coloring material component to separate, aggregate and precipitate, a phenomenon whereby the liquid in which the coloring material is dissolved changes (coagulates) to a solid phase, or a phenomenon whereby the liquid increases in viscosity and hardens, and the like. Furthermore, there are no particular restrictions on the sequence in which the object liquid and the treatment liquid are deposited onto the recording medium, and the object liquid may be deposited after the treatment liquid is deposited.

Preferably, the control device divides the recording medium into a plurality of sectors in accordance with the volume per prescribed surface area of the object liquid deposited on the recording medium, and controls the treatment liquid deposition device in such a manner that volume of the treatment liquid on the recording medium is adjusted in stages in accordance with the sectors.

According to this aspect of the present invention, since the deposition volume of the treatment liquid onto the recording medium is adjusted in stages in accordance with the sectors, then it is possible to deposit the treatment liquid onto the recording medium by means of a relatively simple control procedure.

Preferably, the control device controls the treatment liquid deposition device in such a manner that the treatment liquid is also deposited in a medium-density region on the recording medium, the medium-density region being between the high-density region and the low-density region in terms of the volume per prescribed surface area of the object liquid deposited on the recording medium.

According to this aspect of the present invention, the insolubilization of the coloring material of the object liquid is promoted by the deposition of treatment liquid in the medium-density region, and therefore, the image quality can be improved in the medium-density region.

Preferably, the control device divides the recording medium into a plurality of sectors, including the low-density region, the high-density region, and a medium-density region between the low-density region and the high-density region, in accordance with the volume per prescribed surface area of the object liquid deposited on the recording medium; and controls the treatment liquid deposition device in such a manner that volume of the treatment liquid deposited in the medium-density region is less than the volume of the treatment liquid deposited in the low-density region, and the volume of the treatment liquid deposited in the high-density region is greater than the volume of the treatment liquid deposited in the medium-density region and less than the volume of the treatment liquid deposited in the low-density region.

According to this aspect of the present invention, the deposition volume of the treatment liquid in the high-density region is greater than the deposition volume of the treatment liquid in the medium-density region, and the deposition volume of the treatment liquid in the high-density region is less than the deposition volume of the treatment liquid in the low-density region. Hence, the treatment liquid is deposited in accordance with the density regions.

Preferably, the control device controls the treatment liquid deposition device in such a manner that, in a region on the recording medium where the object liquid having a maximum volume is deposited, the treatment liquid having a volume which is not greater than half of the maximum volume of the object liquid is deposited.

According to this aspect of the present invention, in the region on the recording medium where the deposition volume of the object liquid is a maximum, the deposition volume of the treatment liquid is adjusted to be equal to or less than one half of the maximum deposition volume of the object liquid, thereby improving the image quality.

Preferably, the control device controls the treatment liquid deposition device in such a manner that, in a region on the recording medium where the object liquid having a maximum volume is deposited, the treatment liquid having a volume which is approximately half of the maximum volume of the object liquid is deposited.

According to this aspect of the present invention, in the region on the recording medium where the deposition volume of the object liquid is a maximum, the deposition volume of the treatment liquid is adjusted to be substantially equal to approximately one half of the maximum deposition volume of the object liquid, thereby improving the image quality.

Another aspect of the present invention for achieving the aforementioned object is directed to an image forming method comprising the steps of: depositing an object liquid containing coloring material onto a recording medium; and depositing a treatment liquid which insolubilizes the coloring material onto the recording medium, wherein volume of the treatment liquid deposited in a high-density region on the recording medium where volume per prescribed surface area of the object liquid deposited on the recording medium is high, is lower than volume of the treatment liquid deposited in a low-density region on the recording medium where the volume per prescribed surface area of the object liquid deposited on the recording medium is low.

Preferably, the recording medium is divided into a plurality of sectors in accordance with the volume per prescribed surface area of the object liquid deposited on the recording medium, and control is performed in such a manner that volume of the treatment liquid on the recording medium is adjusted in stages in accordance with the sectors.

Preferably, control is performed in such a manner that the treatment liquid is also deposited in a medium-density region on the recording medium, the medium-density region being between the high-density region and the low-density region in terms of the volume per prescribed surface area of the object liquid deposited on the recording medium.

Preferably, the recording medium is divided into a plurality of sectors, including the low-density region, the high-density region, and a medium-density region between the low-density region and the high-density region, in accordance with the volume per prescribed surface area of the object liquid deposited on the recording medium; and control is performed in such a manner that volume of the treatment liquid deposited in the medium-density region is less than the volume of the treatment liquid deposited in the low-density region, and the volume of the treatment liquid deposited in the high-density region is greater than the volume of the treatment liquid deposited in the medium-density region and less than the volume of the treatment liquid deposited in the low-density region.

Preferably, control is performed in such a manner that, in a region on the recording medium where the object liquid having a maximum volume is deposited, the treatment liquid having a volume which is not greater than half of the maximum volume of the object liquid is deposited.

Preferably, control is performed in such a manner that, in a region on the recording medium where the object liquid having a maximum volume is deposited, the treatment liquid having a volume which is approximately half of the maximum volume of the object liquid is deposited.

According to the present invention, the deposition volume of the treatment liquid in the high-density region on the recording medium is controlled so as to be less than the deposition volume of the treatment liquid in the low-density region, and therefore the insolubilization and dispersion of the coloring material of the object liquid is adjusted in accordance with the deposition volume of the treatment liquid. Therefore, it is possible to achieve dot diameters based on the image densities on the recording medium, and hence an image of high quality is formed in both the low-density region and the high-density region.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 14 is a table showing an evaluation of an image formed on a recording medium by the inkjet recording apparatus;

DETAILED DESCRIPTION OF THE PREFERRED EMBODIMENTS

First Embodiment

Figure 1:
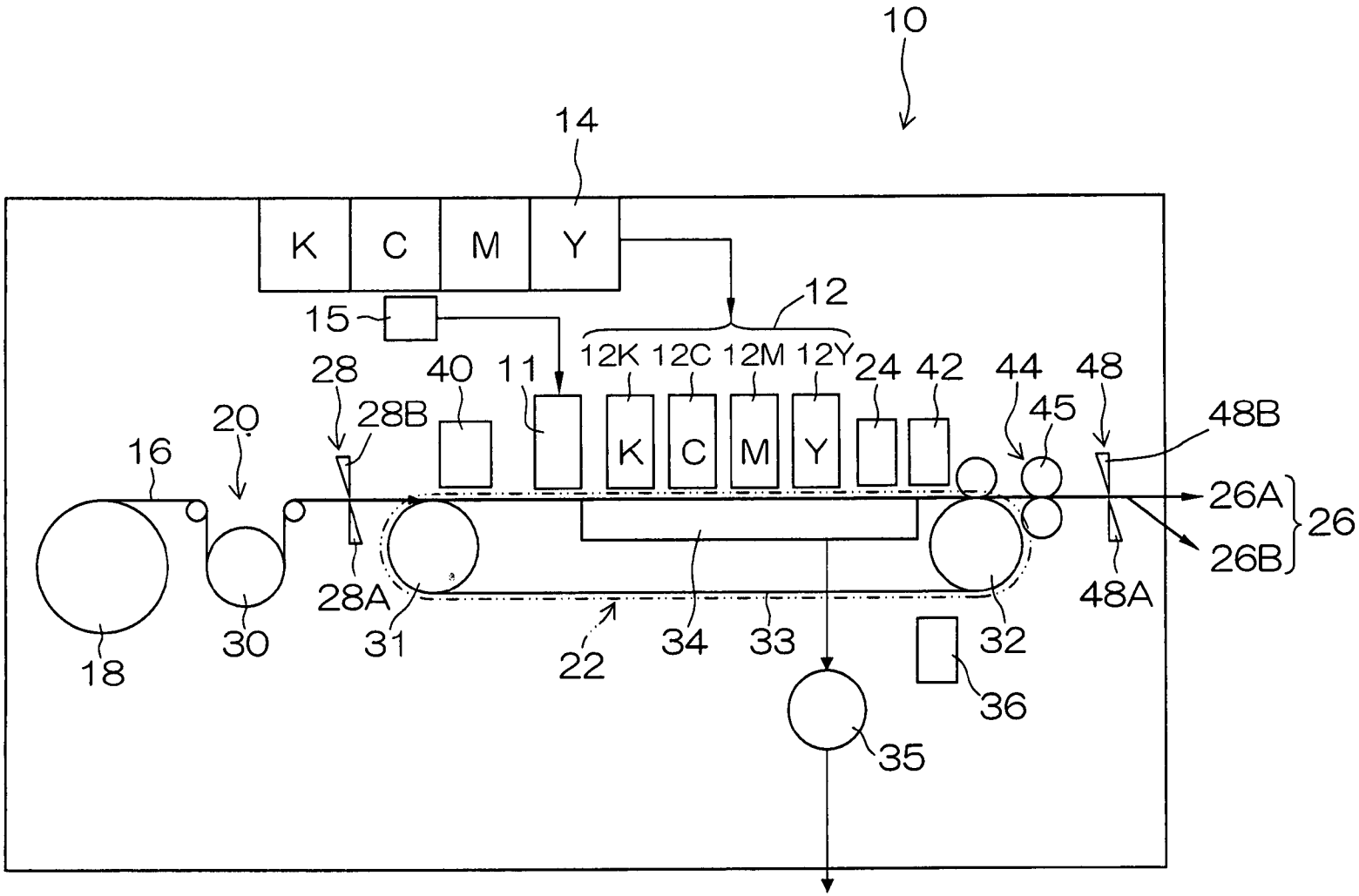
FIG. 1 is a general schematic drawing of an inkjet recording apparatus according to an embodiment of the present invention.

FIG. 1 is a diagram of the general composition of an inkjet recording apparatus 10 according to an embodiment of the present invention. As shown in FIG. 1, the inkjet recording apparatus 10 comprises: a treatment liquid ejection head 11; a print unit 12, which has a plurality of inkjet heads (hereafter, called "heads") 12K, 12C, 12M, and 12Y provided for colors of ink of black (K), cyan (C), magenta (M), and yellow (Y); an ink storing and loading unit 14, which stores colored inks to be supplied to the inkjet heads 12K, 12C, 12M, and 12Y; a treatment liquid storing and loading unit 15, which stores treatment liquid to be supplied to the treatment liquid ejection 11; a media supply unit 18, which supplies a recording medium 16; a decurling unit 20, which removes curl in the recording medium 16; a suction belt conveyance unit 22, which is disposed facing the nozzle face (ink ejection face) of the print unit 12, and conveys the recording medium 16 while keeping the recording medium 16 flat; a print determination unit 24, which reads the printed result produced by the print unit 12; and an output unit 26, which outputs the recorded recording medium (printed matter) to the exterior.

The ink storing and loading unit 14 has a plurality of ink tanks and the respective ink tanks store inks of colors corresponding to the inkjet heads 12K, 12C, 12M and 12Y. Furthermore, each ink tank is connected to an inkjet head 12K, 12C, 12M and 12Y by means of prescribed channels. The ink storing and loading unit 14 has a warning device (for example, a display device or an alarm sound generator) for warning when the remaining amount of any ink is low, and it also has a mechanism for preventing loading errors among the colors.

Similarly to the ink storing and loading unit 14, the treatment liquid storing and loading unit 15 also comprises a warning device (for example, a display device or an alarm sound generator) for warning when the remaining amount of any treatment liquid is low, as well as having a mechanism for preventing loading errors among the types of liquid.

The ink used in the present embodiment is, for instance, colored ink including anionic polymer, namely, a polymer containing negatively charged surface-active ions. Furthermore, the treatment liquid used in the present embodiment is, for instance, a transparent reaction promotion agent including cationic polymer, namely, a polymer containing positively charged surface-active ions. Concrete embodiments of the component substances of the ink and the treatment liquid are described below.

When the ink and the treatment liquid mix together, an insolubilization and/or fixing reaction of the coloring material in the ink proceeds due to the chemical reaction. The term "insolubilization" includes a phenomenon whereby the coloring material in the ink leaves a state where it is dissolved or dispersed in the solvent of the liquid due to the action of the treatment liquid on the ink, thereby causing the coloring material component to separate, aggregate and precipitate, a phenomenon whereby the liquid in which the coloring material is dissolved changes (coagulates) to a solid phase, and a phenomenon whereby the liquid increases in viscosity and hardens, or the like. Furthermore, the term "fixing" may indicate a mode where the coloring material is held on the surface of the recording medium 16, a mode where the coloring material permeates into the recording medium 16 and is held therein, or a mode where these states are combined.

The reaction speed and the characteristics (e.g., surface tension, viscosity, or the like) of the ink and the treatment liquids can be adjusted by regulating the compositions of the ink and treatment liquids, the concentration of the materials contributing to the reaction, or the like, and thereby desired ink insolubility and/or desired ink fixing properties (hardening speed, fixing speed, or the like) can be achieved. The conditions of properties of the treatment liquids and the ink used in the present embodiment are described later.

As regards the supply system for the recording medium 16, in FIG. 1, a magazine for rolled paper (continuous paper) is shown as an embodiment of the media supply unit 18; however, a plurality of magazines with papers of different paper width and quality may be jointly provided. Moreover, papers may be supplied in cassettes that contain cut papers loaded in layers and that are used jointly or in lieu of magazines for rolled papers.

In the case of a composition in which a plurality of types of different recording media can be used, it is also possible to attach an information recording body, such as a barcode or a radio tag, or the like, on which information relating to the type of recording medium is recorded, to the magazine. In this case, it is preferable that the type of recording medium (media type) used is determined automatically by reading the information in the information recording body by means of a prescribed reading apparatus and ejection is controlled in such a manner that treatment liquid and ink are ejected in a suitable fashion in accordance with the type of medium.

The recording medium 16 delivered from the media supply unit 18 retains curl due to having been loaded in the magazine. In order to remove the curl, heat is applied to the recording medium 16 in the decurling unit 20 by a heating drum 30 in the direction opposite from the curl direction in the magazine. The heating temperature at this time is preferably controlled so that the recording medium 16 has a curl in which the surface on which the print is to be made is slightly round outward.

In the case of the configuration in which roll paper is used, a first cutter 28 is provided as shown in FIG. 1, and the roll paper is cut to a desired size by the first cutter 28. The first cutter 28 comprises a stationary blade 28A having a length is not less than the width of the conveyance path of the recording medium 16, and a circular blade 28B which moves along the stationary blade 28A. The stationary blade 28A is provided on the rear side of the print surface of the recording medium, and the circular blade 28B is disposed on the print surface side, across the conveyance path from the stationary blade 28A. When cut paper is used, the first cutter 28 is not required.

The decurled and cut recording medium 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording medium 16, and a plurality of suction apertures (not shown) are formed on the belt surface. As shown in FIG. 1, a suction chamber 34 is provided on the inner side of the belt 33 wound between the rollers 31 and 32, at a position opposing the nozzle surface of the print unit 12 and a position opposing the sensor surface of the print determination unit 24. The recording medium 16 is suctioned and held onto the belt 33 due to the negative pressure created by suctioning the suction chamber 34 with a fan 35.

The belt 33 is driven in the clockwise direction in FIG. 1 by the motive force of a motor (see "88" in FIG. 9) being transmitted to at least one of the rollers 31 and 32, which the belt 33 is set around, and the recording medium 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration for nipping with cleaning rollers such as a brush roller and a water absorbent roller, an air blow configuration in which clean air is blown onto the belt 33, or a combination of these. In the case of the configuration for nipping with the cleaning rollers, it is preferable to make the line velocity of the cleaning rollers different from that of the belt 33 to improve the cleaning effect.

The inkjet recording apparatus 10 can comprise a roller nip conveyance mechanism, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the media conveyance pathway formed by the suction belt conveyance unit 22. The heating fan 40 blows heated air onto the recording medium 16 to heat the recording medium 16 immediately before printing so that the ink deposited on the recording medium 16 dries more easily.

Figure 2:
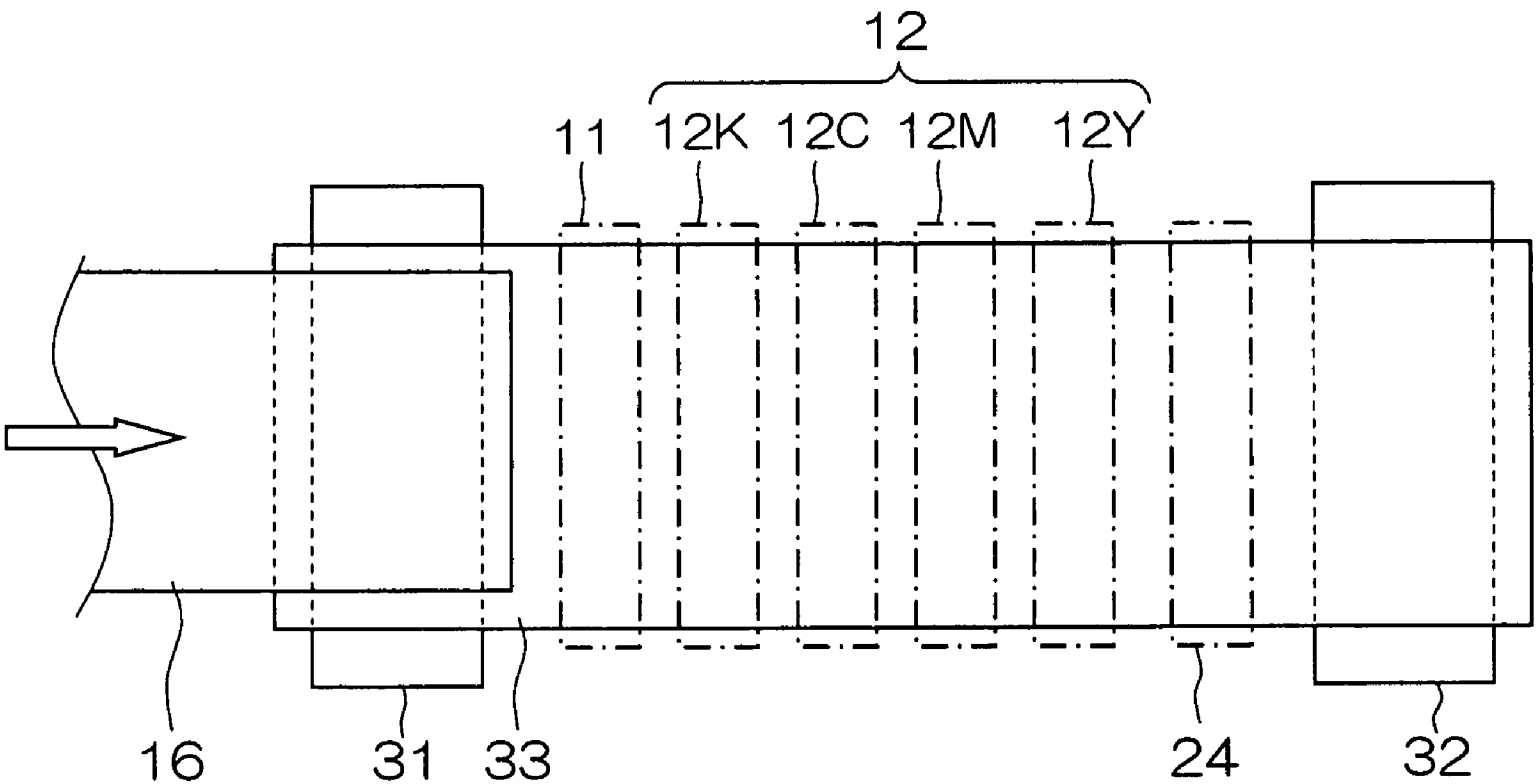
FIG. 2 is a principal plan diagram showing the peripheral area of a print unit of an inkjet recording apparatus.

The treatment liquid ejection head 11 and the inkjet heads 12K, 12M, 12C and 12Y of the print unit 12 are full line heads having a length corresponding to the maximum width of the recording medium 16 used with the inkjet recording apparatus 10 (see FIG. 2), and comprising nozzles for ejecting ink or nozzles for ejecting treatment liquid arranged on a nozzle face through a length exceeding at least one edge of the maximum-size recording paper (namely, the full width of the printable range).

The inkjet heads 12K, 12C, 12M and 12Y of the print unit 12 are arranged in the sequence of the colors, black (K), cyan (C), magenta (M) and yellow (Y), from the upstream side, in the direction of conveyance of the recording medium 16, and the treatment liquid ejection head 11 is disposed further to the upstream side of the print unit 12. The treatment liquid ejection head 11 and the inkjet heads 12K, 12C, 12M and 12Y are disposed in fixed positions in such a manner that they extend in a direction substantially perpendicular to the conveyance direction of the recording medium 16. By means of this head arrangement, it is possible to cause the treatment liquid to adhere to the print surface (recording surface) of the recording medium 16 by means of the treatment liquid ejection head 11, before ejecting colored inks from the print unit 12.

A color image can be formed on the recording medium 16 by ejecting inks of different colors from the inkjet heads 12K, 12C, 12M and 12Y, respectively, onto the recording medium 16 while the recording medium 16 is conveyed by the suction belt conveyance unit 22.

By adopting a configuration in which the full line inkjet heads 12K, 12C, 12M and 12Y having nozzle rows covering the full paper width are provided for the respective colors in this way, it is possible to record an image on the full surface of the recording medium 16 by performing just one operation (one sub-scanning operation) of relatively moving the recording medium 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the inkjet heads of respective colors are arranged.

The print determination unit 24 shown in FIG. 1 has an image sensor for capturing an image of the ink-droplet deposition result of the printing unit 12, and functions as a device to check for ejection defects such as clogs of the nozzles from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the inkjet heads 12K, 12C, 12M, and 12Y This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

A test pattern or the target image printed by the print inkjet heads 12K, 12C, 12M, and 12Y of the respective colors is read in by the print determination unit 24, and the ejection performed by each inkjet heads 12K, 12C, 12M, and 12Y is determined. The ejection determination includes detection of the ejection, measurement of the dot size, and measurement of the dot formation position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively.

When the target print and the test print are simultaneously formed in parallel on the same large sheet of paper, the test print portion is cut and separated by a second cutter 48. The second cutter 48 is disposed directly in front of the output unit 26, and is used for cutting the test print portion from the target print portion when a test print has been performed in the blank portion of the target print. The structure of the second cutter 48 is the same as the first cutter 28 described above, and has a stationary blade 48A and a round blade 48B.

The paper output unit 26A for the target prints is provided with a sorter (not shown in Figs.) for collecting prints according to print orders.

Next, the structure of the inkjet heads 12K, 12C, 12M, and 12Y is described below. The inkjet heads 12K, 12C, 12M, and 12Y of the respective ink colors have the same structure, and a reference numeral 50 is hereinafter designated to any of the inkjet heads 12K, 12C, 12M, and 12Y.

Figure 3:
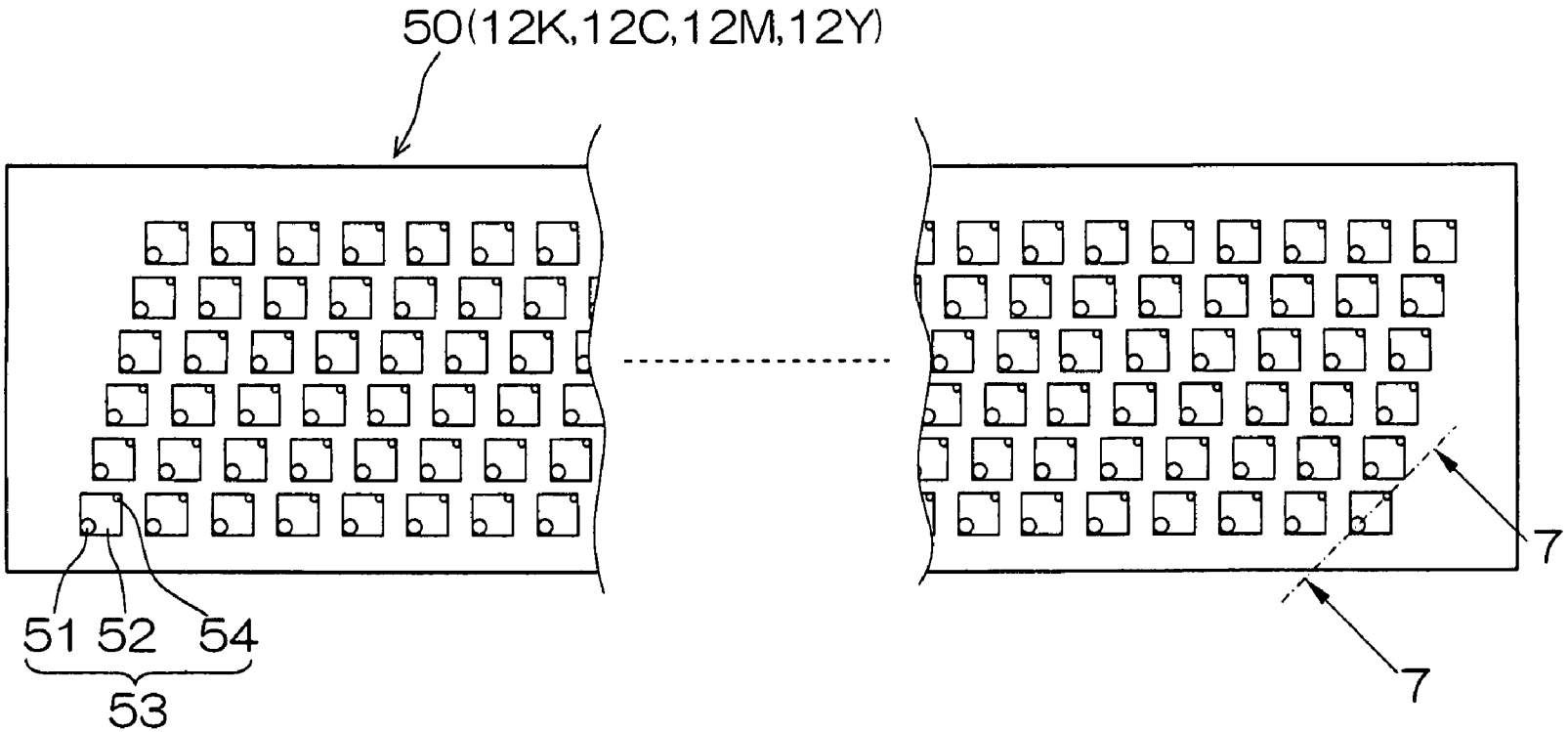
FIG. 3 is a plan perspective diagram showing an embodiment of the structure of an inkjet head.
Figure 4:
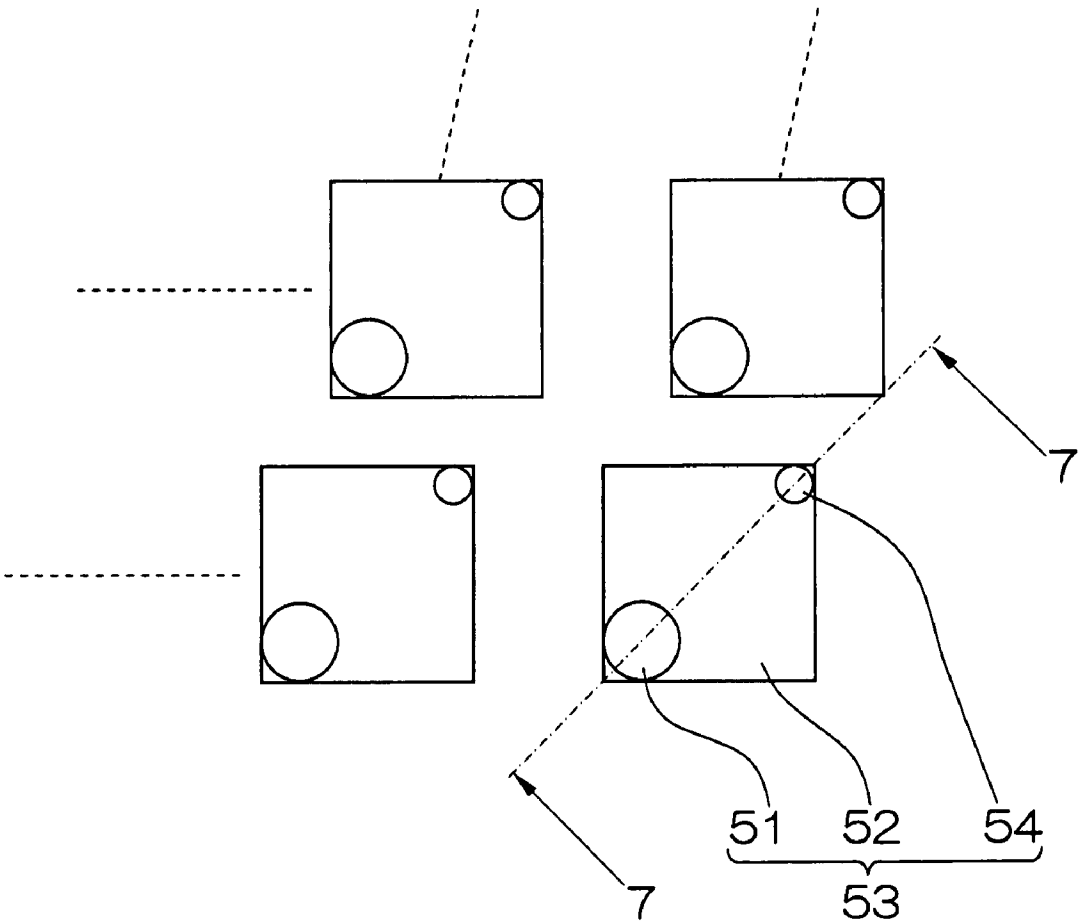
FIG. 4 is an enlarged diagram of one portion of an inkjet head.

FIG. 3 is a plan view perspective diagram showing an embodiment of the structure of inkjet head 50. FIG. 4 is an enlarged diagram of one portion of an inkjet head 50. In order to achieve a high density of the dot pitch printed onto the surface of the recording medium 16, it is necessary to achieve a high density of the nozzle pitch in the inkjet head 50. As shown in FIG. 3 and FIG. 4, the inkjet head 50 according to the present embodiment has a structure in which ink chamber units (liquid droplet ejection elements) 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced (high nozzle density is achieved).

Figure 5:
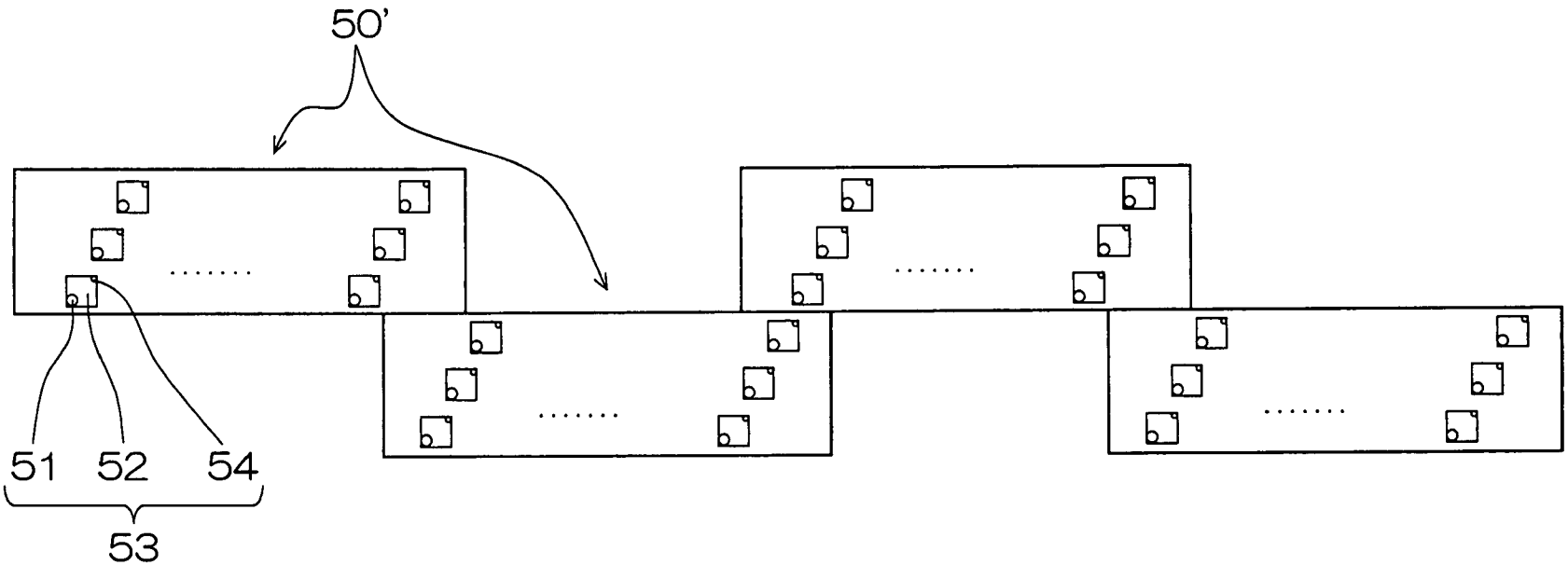
FIG. 5 is a plan view perspective diagram showing a further embodiment of the structure of an inkjet head.

The mode of forming one or more nozzle rows having a length corresponding to the entire width of the recording medium 16 in a direction substantially orthogonal to the conveyance direction of the recording medium 16 is not limited to the embodiment described here. FIG. 5 is a plan view perspective diagram showing a further embodiment of the structure of inkjet head 50. For example, instead of the composition in FIG. 3, as shown in FIG. 5, a line head having nozzle rows of a length corresponding to the entire width of the recording medium 16 can be formed by arranging and combining, in a staggered matrix, short head units 50' each having a plurality of nozzles 51 arrayed in a two-dimensional fashion.

The planar shape of the pressure chamber 52 provided for each nozzle 51 of the inkjet head 50 is substantially a square shape (see FIGS. 3 and 4), and an ejection port connected to the nozzle 51 and an inlet for supplied ink (supply port) 54 are disposed in either corner on a diagonal line of the square.

Figure 6:
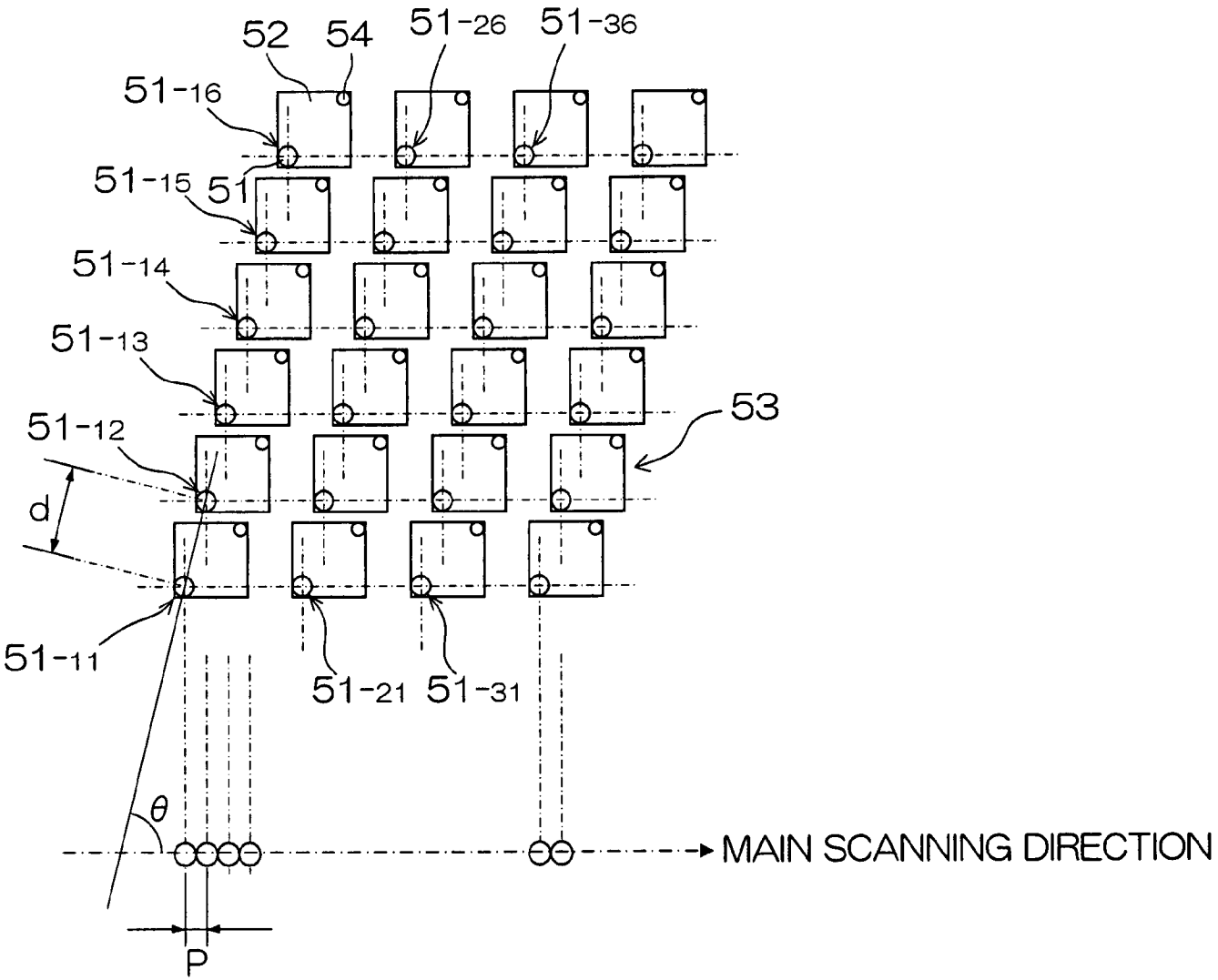
FIG. 6 is a diagram showing a nozzle arrangement in a head.

As shown in FIG. 6, the high-density nozzle head according to the present embodiment is achieved by composing the plurality of ink chamber units 53 having this structure in a lattice arrangement, based on a fixed arrangement pattern having a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected to an alignment in the main scanning direction is $d \times \cos\theta$, and hence it is possible to treat the nozzles 51 as if they are arranged linearly at a uniform pitch of P. By adopting a composition of this kind, it is possible to achieve nozzle rows of high density.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording medium (the direction perpendicular to the conveyance direction of the recording medium) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix configuration such as that shown in FIG. 6 are driven, it is desirable that main scanning is performed in accordance with (3) described above. In other words, taking the nozzles 51-11, 51-12, 51-13, 51-14, 51-15 and 51-16 as one block (and furthermore, taking nozzles 51-21, . . . , 51-26 as one block, and nozzles 51-31, . . . , 51-36 as one block), one line is printed in the breadthways direction of the recording medium 16 by sequentially driving the nozzles 51-11, 51-12, . . . , 51-16 in accordance with the conveyance speed of the recording medium.

On the other hand, "sub-scanning" is defined as to repeatedly perform printing of one line (a line formed of a row of dots, or a line formed of a plurality of rows of dots) formed by the main scanning, while moving the full-line head and the recording medium 16 relatively to each other.

In implementing the present invention, the arrangement of the nozzles is not limited to that of the embodiment illustrated. Moreover, a method is employed in the present embodiment where an ink droplet is ejected by means of the deformation of the actuator 58, which is typified by a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink being ejected by means of the pressure applied by these bubbles.

The structure of the treatment liquid ejection head 11 is substantially the same as that of the inkjet head 50 of the print unit 12 described above.

Since the treatment liquid is applied to the recording medium 16 in a substantially uniform (even) fashion in the region where ink droplets are to be ejected, generally, it is not necessary to form dots of the treatment liquid to a high resolution, in comparison with the ink. Consequently, the treatment liquid ejection head 11 may have a reduced number of nozzles (a reduced nozzle density) in comparison with the inkjet head 50 for ejecting ink. Furthermore, a composition may also be adopted in which the nozzle diameter of the treatment liquid ejection head 11 is greater than the nozzle diameter of the inkjet head 50 for ejecting ink.

Figure 7:
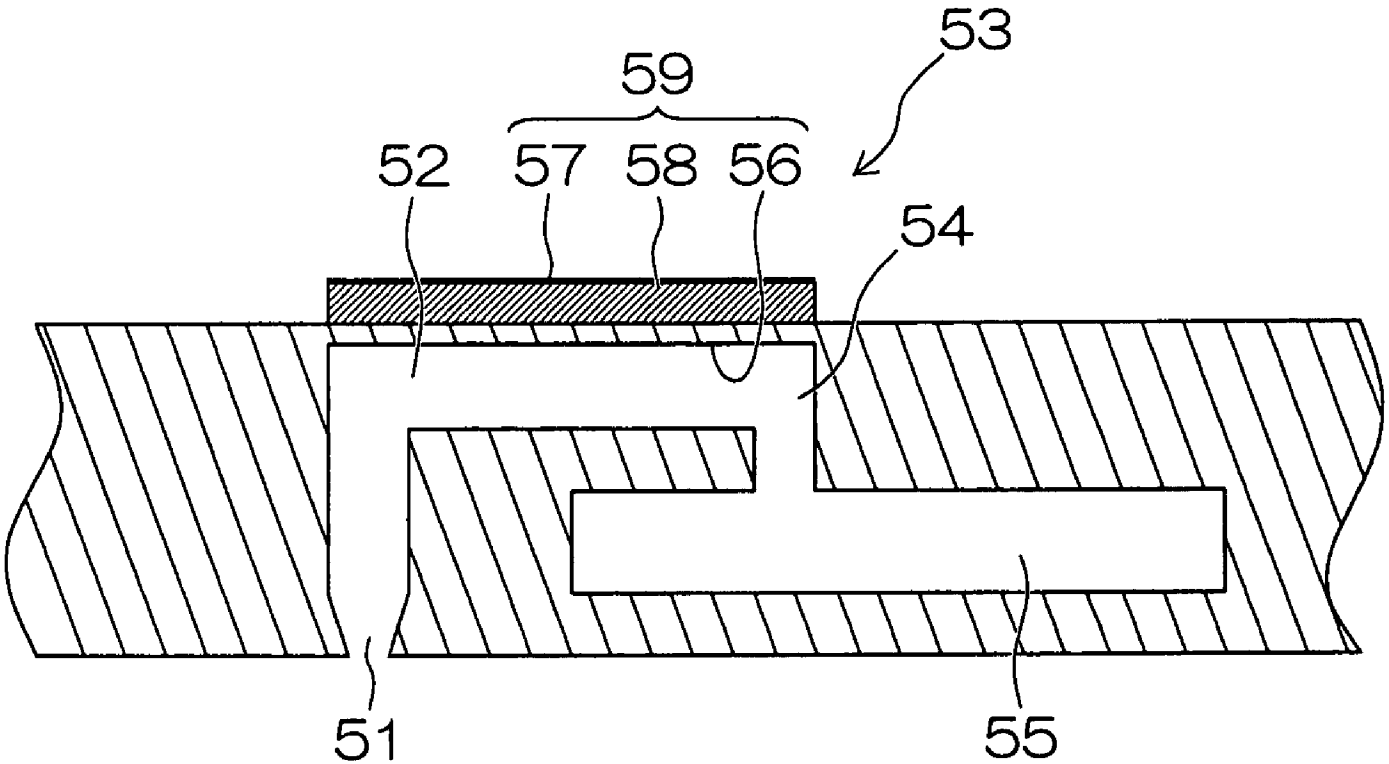
FIG. 7 is a cross-sectional diagram along line 7-7 in FIG. 4.

FIG. 7 is a cross-sectional diagram (along line 7-7 in the FIG. 4) showing the three-dimensional composition of one of the liquid droplet ejection elements (an ink chamber unit corresponding to one nozzle 51). As shown in FIG. 7, each pressure chamber 52 is connected to a common flow passage 55 via the supply port 54. The common flow channel 55 is connected to an ink tank 60 (see FIG. 8), which is a base tank that supplies ink, and the ink supplied from the ink tank is delivered through the common flow channel 55 shown in FIG. 7 to the pressure chambers 52.

An actuator 58 provided with an individual electrode 57 is bonded to a pressure plate 56 (a diaphragm that also serves as a common electrode) which forms the ceiling of the pressure chamber 52. When a drive voltage is applied to the individual electrode 57, the actuator 58 is deformed, the volume of the pressure chamber 52 is thereby changed, and the pressure in the pressure chamber 52 is thereby changed, so that the ink is thus ejected through the nozzle 51. When ink is ejected, new ink is supplied to the pressure chamber 52 from the common flow channel 55 through the supply port 54. The actuator 58 is preferably a piezoelectric element.

Figure 8:
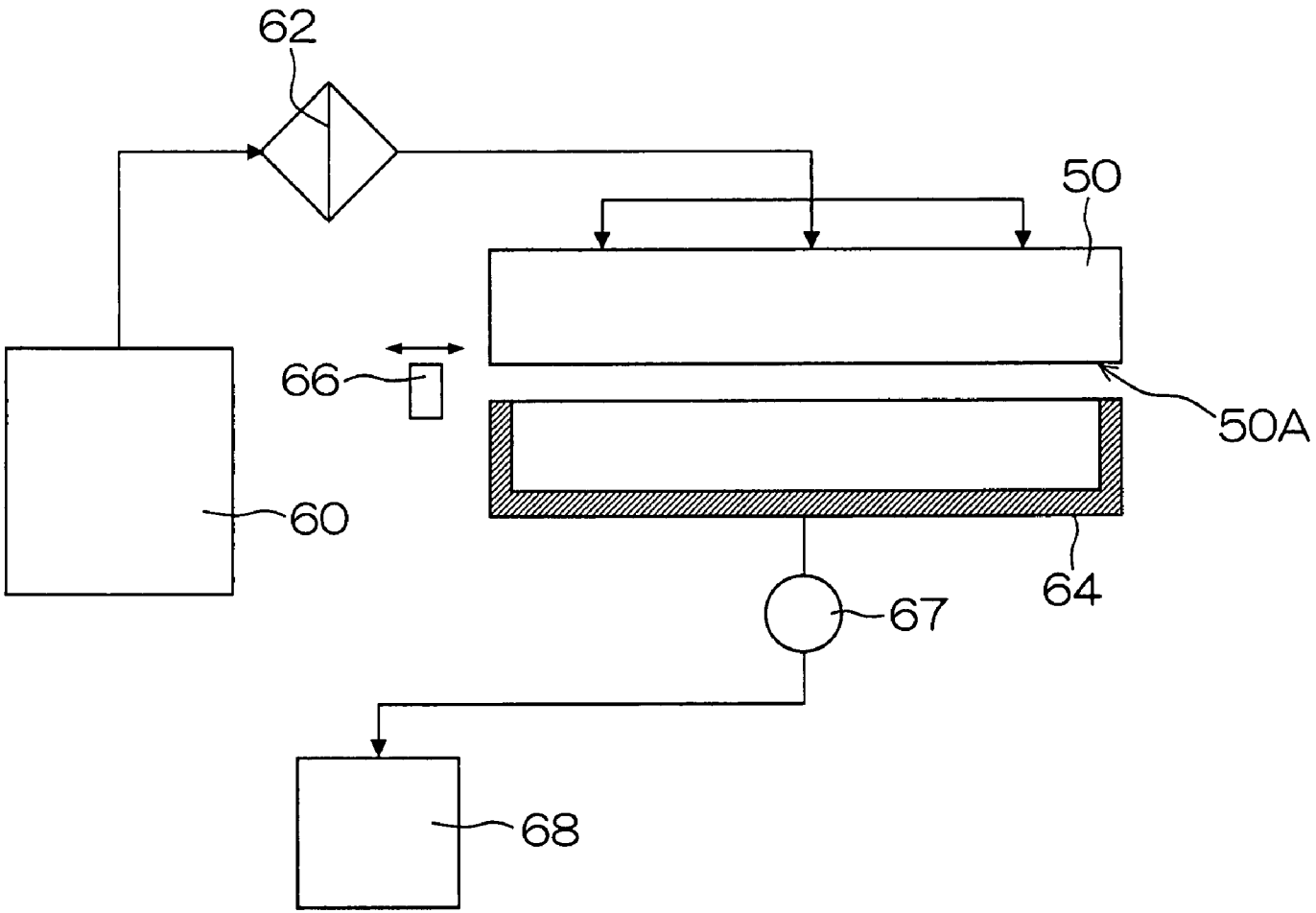
FIG. 8 is a schematic drawing showing the composition of an ink supply system in the inkjet recording apparatus.

FIG. 8 is a schematic drawing showing the configuration of the ink supply system in the inkjet recording apparatus 10. The ink tank 60 is a base tank that supplies ink to the inkjet head 50 and is set in the ink storing and loading unit 14 described with reference to FIG. 1. In other words, the ink supply tank 60 in FIG. 8 is equivalent to the ink storing and loading unit 14 in FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

A filter 62 for removing foreign matters and bubbles is disposed between the ink tank 60 and the inkjet head 50 as shown in FIG. 8. The filter mesh size in the filter 62 is preferably equivalent to or less than the diameter of the nozzle. Although not shown in FIG. 8, it is preferable to provide a sub-tank integrally to the inkjet head 50 or nearby the inkjet head 50. The sub-tank has a damper function for preventing variation in the internal pressure of the inkjet head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit (restoring device) including the cap 64 and the cleaning blade 66 can be relatively moved with respect to the inkjet head 50 by a movement mechanism (not shown), and is moved from a predetermined holding position to a maintenance position below the inkjet head 50 as required.

The cap 64 is displaced up and down relatively with respect to the inkjet head 50 by an elevator mechanism (not shown). When the power of the inkjet recording apparatus 10 is turned OFF or when in a print standby state, the cap 64 is raised to a predetermined elevated position so as to come into close contact with the inkjet head 50, and the nozzle face 50A is thereby covered with the cap 64.

The cleaning blade 66 is composed of rubber or another elastic member, and can slide on the nozzle face 50A (surface of the nozzle plate) of the inkjet head 50 by means of a blade movement mechanism (not shown). When ink droplets or foreign matter has adhered to the nozzle plate surface, the surface of the nozzle plate is wiped by sliding the cleaning blade 66 on the nozzle plate.

During printing or standby, when the frequency of use of specific nozzles is reduced and ink viscosity increases in the vicinity of the nozzles, a preliminary discharge is made to eject the degraded ink toward the cap 64.

When a state in which ink is not ejected from the inkjet head 50 continues for a certain amount of time or longer, the ink solvent in the vicinity of the nozzles 51 evaporates and ink viscosity increases. In such a state, ink can no longer be ejected from the nozzle 51 even if the actuator 58 for the ejection driving is operated. Before reaching such a state (in a viscosity range that allows ejection by the operation of the actuator 58) the actuator 58 is operated to perform "preliminary discharge" to eject the ink whose viscosity has increased in the vicinity of the nozzle toward the ink receptor. After the nozzle surface is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

On the other hand, if air bubbles become intermixed into the nozzle 51 or pressure chamber 52, or if the rise in the viscosity of the ink inside the nozzle 51 exceeds a certain level, then it may not be possible to eject ink in the preliminary ejection operation described above. In cases of this kind, a cap 64 forming a suction device is pressed against the nozzle surface 50A of the inkjet head 50, and the ink inside the pressure chambers 52 (namely, the ink containing air bubbles of the ink of increased viscosity) is suctioned by a suction pump 67. The ink suctioned and removed by means of this suction operation is sent to a collection tank 68. The ink collected in the collection tank 68 may be reused, or if reuse is not possible, it may be discarded.

Since the suctioning operation is performed with respect to all of the ink in the pressure chambers 52, it consumes a large amount of ink, and therefore, desirably, preliminary ejection is carried out while the increase in the viscosity of the ink is still minor. The suctioning operation is also carried out when ink is loaded into the inkjet head 50 for the first time, and when the head starts to be used after being idle for a long period of time.

The supply system for the treatment liquid is not illustrated, but it is substantially the same as the composition of the ink supply system shown in FIG. 8.

Figure 9:
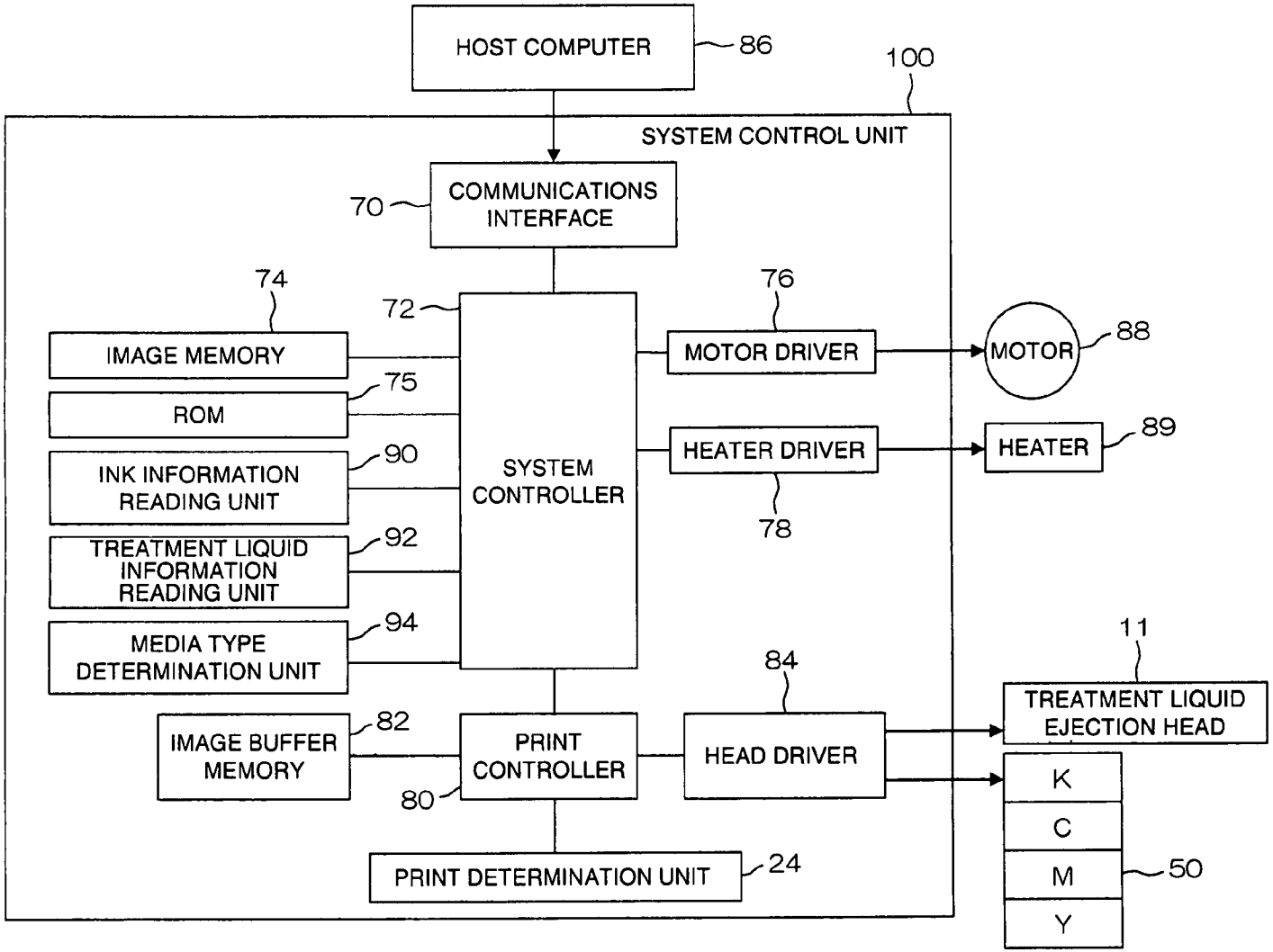
FIG. 9 is a block diagram showing one embodiment of a system control unit of the inkjet recording apparatus and the hardware composition peripheral to same.

FIG. 9 is a block diagram showing one embodiment of a system control unit 100 of the inkjet recording apparatus 10 and the hardware composition peripheral to same. The system control unit 100 comprises a communications interface 70, a system controller 72, an image memory 74, a ROM 75, a motor driver 76, a heater driver 78, a print control unit 80, an image buffer memory 82, a head driver 124, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like. The system controller 72 controls communications with the host computer 86 and writing and reading to and from the image memory 74, and generates control signals for controlling the motor 88 and heater 89 of the conveyance system.

The program executed by the CPU of the system controller 72 and the various types of data which are required for control procedures are stored in the ROM 75. The ROM 75 may be a non-writeable storage device, or it may be a rewriteable storage device, such as an EEPROM. The image memory 74 is used as a temporary storage region for the image data, and it is also used as a program development region and a calculation work region for the CPU.

The motor driver 76 is a driver (drive circuit) that drives the motor 88 in accordance with commands from the system controller 72. The heater driver 78 drives the heater 89 of the post-drying unit 42, and the like, in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print data (dot data) to the head driver 124. Required signal processing is carried out in the print controller 80, and the range of the deposition for the treatment liquid, the ejection amount and the ejection timing of the ink droplets are controlled via the head driver 124, on the basis of the print data. By this means, the desired dot size and the desired dot positions can be achieved.

The print controller 80 is provided with the image buffer memory 82; and image data, parameters, and other data are temporarily stored in the image buffer memory 82 when the image data is processed in the print controller 80. The aspect shown in FIG. 9 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 124 drives the actuators 58 in the inkjet heads 50 of the respective colors, on the basis of the print data supplied from the print controller 80, and it also drives the actuators of the treatment liquid ejection head 11. A feedback control system for maintaining constant drive conditions for the heads may be included in the head driver 124.

The image data to be printed is externally inputted through the communication interface 70, and is stored in the image memory 74. In this stage, the RGB image data is stored in the image memory 74.

The image data stored in the image memory 74 is sent to the print controller 80 through the system controller 72, and is converted to the dot data for each ink color by a half-toning technique, such as dithering or error diffusion, in the print controller 80. In this inkjet recording apparatus 10, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal gradations of the image (namely, the light and shade toning of the image) as faithfully as possible.

In other words, the print controller 80 performs processing for converting the input RGB image data into dot data for the four colors of K, C, M and Y. Furthermore, the print controller 80 judges the droplet ejection region of the treatment liquid (the region of the recording surface where ejection of treatment liquid is required) on the basis of the dot data of the respective colors, and thus generates dot data for the ejection of treatment liquid droplets. The dot data (for the treatment liquid and the respective colors) generated by the print controller 80 is stored in the image buffer memory 82.

The head driver 124 generates drive control signals for the treatment liquid ejection head 11 and the inkjet heads 50 of the respective ink colors, on the basis of the dot data stored in the image buffer memory 82. By supplying the drive control signals generated by the head driver 124 to the treatment liquid ejection head 11 and the inkjet heads 50 of respective ink colors, treatment liquid is ejected from the treatment liquid ejection head 11 and inks are ejected from the inkjet heads 50. By controlling the ejection of treatment liquid from the treatment liquid ejection head 11 and the ejection of ink from the inkjet heads 50 in synchronism with the conveyance speed of the recording medium 16, an image is formed on the recording medium 16.

The print determination unit 24 is a block that includes the line sensor as described above with reference to FIG. 1, reads the image printed on the recording medium 16, determines the print conditions (presence of the ejection, variation in the dot formation, optical density, and the like) by performing required signal processing, and the like, and provides the determination results of the print conditions to the print controller 80.

According to requirements, the print controller 80 makes various corrections with respect to the inkjet head 50 on the basis of information obtained from the print determination unit 24. Furthermore, the system controller 72 implements control for carrying out preliminary ejection, suctioning, and other prescribed restoring processes, on the basis of the information obtained from the print determination unit 24.

The inkjet recording apparatus 10 according to this embodiment also has an ink information reading unit 90, a treatment liquid information reading unit 92 and a media type determination unit 94. The ink information reading unit 90 is a device for reading in information relating to the ink type. More specifically, it is possible to use, for example, a device which reads in ink identification information or ink properties information from the shape of the cartridge in the ink tank 60 (see FIG. 8) (a specific shape which allows the ink type to be identified), or from a bar code or IC chip incorporated into the cartridge. Besides this, it is also possible for an operator to input the required information by means of a user interface.

Similarly, the treatment liquid information reading unit 92 is a device for acquiring information relating to the type of treatment liquid. More specifically, it is possible to use, for example, a device which reads in identification information or properties information relating to the treatment liquid from the shape of the cartridge in the treatment liquid tank (not illustrated) of the treatment liquid storing and loading unit 15 (a specific shape which allows the liquid type to be identified), or from a bar code or IC chip incorporated into the cartridge. Besides this, it is also possible for an operator to input the required information by means of a user interface.

The media type determination unit 94 is a device for determining the type and size of the recording medium. This section uses, for example, a device for reading in information (e.g., identification information and media type information), from a bar code attached to the magazine in the media supply unit 18, or sensors disposed at a suitable position in the paper conveyance path (e.g., a media width determination sensor, a sensor for determining the thickness of the media, a sensor for determining the reflectivity of the media, or the like). A suitable combination of these elements may also be used. Furthermore, it is also possible to adopt a composition in which information relating to the paper type, size, and the like, is specified by means of an input via a prescribed user interface, instead of or in conjunction with such automatic determination devices.

The information acquired by the various devices, namely, the ink information reading unit 90, the treatment liquid information reading unit 92 and the media type determination unit 94 is sent to the system controller 72, where the information is used for selecting the treatment liquid and for controlling ejection of the ink (e.g., the ejection volume and the ejection timing), in such a manner that suitable droplet ejection is performed in accordance with the conditions. More specifically, the system controller 72 determines the permeation speed characteristics of the recording medium 16 on the basis of the information obtained from the respective devices of the ink information reading unit 90, the treatment liquid reading unit 92 and the media type determination unit 94, and the system controller 72 decides whether to use a treatment liquid or not. If a treatment liquid is to be used, the system controller 72 selects the type of liquid for the treatment liquid and controls the volume of the treatment liquid to be ejected.

As described in FIG. 1, in the inkjet recording apparatus 10 according to the present embodiment, a composition is adopted in which the treatment liquid ejection head 11 is disposed before the most upstream position of the print unit 12, and before ejecting droplets of ink from the print unit 12, the treatment liquid is previously applied to the print surface of the recording medium 16 by means of a single operation by the preceding treatment liquid ejection head 11. In the case of this composition, the amount of treatment liquid on the recording medium 16 gradually declines as the volume of the ink droplets ejected by the print unit 12 increases, and therefore, the further the position toward the downstream side of the print unit 12, the smaller the amount of treatment liquid on the recording medium 16. Since it is necessary for some treatment liquid to be remaining in the vicinity of the surface of the recording medium 16 until droplet ejection by the inkjet head in the final stage (furthest downstream position) of the print unit 12 (in FIG. 1, the stage of the yellow inkjet head 12Y) has been completed, then the amount of treatment liquid ejected by the treatment liquid ejection head 11 is determined on the basis of the type of recording medium 16, the properties of the treatment liquid, the ejected ink volume, the conveyance speed of the recording medium 16, and the like, in such a manner that the required amount of the treatment liquid can be; ensured.

The inkjet recording apparatus 10 comprises an information storage device (for example, the ROM 75 shown in FIG. 9, or an internal memory or external memory (not illustrated)) which stores data of a media type table that associates the media type with the permeation speed characteristics, and the system controller 72 determines the permeation speed characteristics of the recording medium 16 used by referring to this media type table.

If, for example, a permeable paper having a fast permeation speed is used, then a treatment liquid having a higher surface tension is selected in comparison with a case where a permeable paper having a low permeation speed (or a non-permeable paper) is used. In the present embodiment, if the surface tension of the treatment liquid A is greater than the surface tension of the treatment liquid B, then when using a permeable paper having a fast permeation speed, the actuators in the treatment liquid ejection head 11 corresponding to the nozzle row 11A which ejects treatment liquid A are driven and hence treatment liquid A is ejected from the treatment liquid ejection head 11. On the other hand, if permeable paper having a slow permeation speed, or non-permeable paper, is used, then the actuators of the treatment liquid ejection head 11 corresponding to the nozzle row 11B which ejects treatment liquid B are driven, and hence treatment liquid B is ejected from the treatment liquid ejection head 11.

According to the above, even in the case of a permeable paper of fast permeation speed, it is possible to reduce the permeation speed of the treatment liquid A by using a treatment liquid A which has a large surface tension.

Alternatively, when a permeable paper having a fast permeation speed is used, there is also a control mode in which no treatment liquid is used (droplets of treatment liquid are not ejected and an image is formed by means of ink only).

Here, a "permeable paper having a fast permeation speed" means a permeable paper in which the time required for a first liquid (treatment liquid) to permeate completely into the paper is shorter than the time difference between the droplet ejection times of the first liquid (treatment liquid) and a second liquid (ink). If a medium having high permeability on which it is difficult to guarantee the presence of a prescribed quantity of treatment liquid on the recording surface when ink droplets are ejected is used, then there is little sense in using the treatment liquid, and conversely, bleeding of the ink may be promoted. Therefore, in such cases, it is preferable not to use treatment liquid.

In other words, in the case of permeable paper, there is less bleeding of the ink when only ink droplets are ejected, compared to a case where ink droplets are ejected onto treatment liquid. This is because the higher the surface tension, the lower the extent of bleeding, and when ink droplets are ejected onto treatment liquid, the ink tends to bleed as a result of bleeding of the treatment liquid. Consequently, it is possible to suppress bleeding by selecting the surface tension of the treatment liquid, or by selecting whether or not to use treatment liquid, depending on whether or not a permeable paper or a non-permeable paper is used, and thus performing droplet ejection in accordance with the characteristics of the recording medium.

As a device for ascertaining the permeation speed characteristics of the recording medium 16, it is possible to obtain the ID (identification information) of the media from the media type determination unit 94, and then ascertain the permeation speed characteristics of the media by referring to a media type table, or alternatively, it is possible to record information indicating the permeation speed characteristics of the media on an information recording body, such as a barcode attached to a magazine, and to then read in the information relating to the permeation speed characteristics of the media directly from the media type determination unit 94.

Alternatively, it is also possible to use a device which actually measures the permeation speed of the recording medium 16. For example, ink, or treatment liquid, or both ink and treatment liquid are ejected onto the recording medium 16, the state of the dots formed by this test droplet ejection is read in by a determination device, such as an imaging element, (this determination device may be substituted by the print determination unit 24), and the permeation speed can be calculated on the basis of the information thus obtained.

Figure 10:
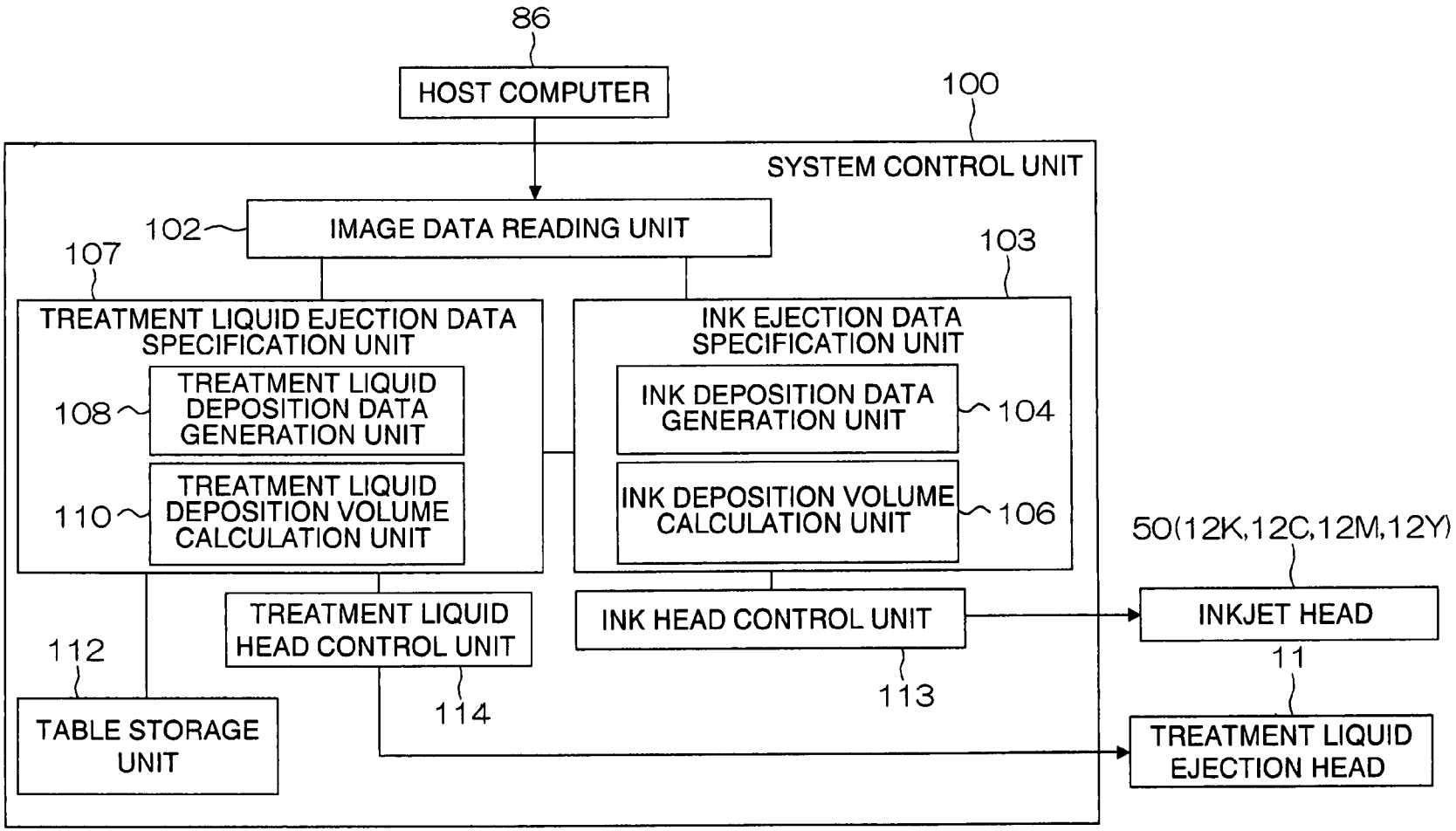
FIG. 10 is a block diagram showing the functional composition of a system control unit according to a first embodiment.

FIG. 10 is a block diagram showing the functional composition of the system control unit 100, and in particular, it relates to the control of the inkjet head 50 and the treatment liquid ejection head 11. The system control unit 100 comprises an image data reading unit 102, an ink ejection data specification unit 103, a treatment liquid ejection data specification unit 107, a table storage unit 112, an ink head control unit 113, and a treatment liquid head control unit 114.

The image data reading unit 102 reads image data (print data) and data relating to the operating mode, and the like, supplied to the system control unit 100 from an external host computer 86, and it supplies this data to the ink ejection data specification unit 103 and the treatment liquid ejection data specification unit 107.

The ink ejection data specification unit 103 comprises an ink deposition data generation unit 104 and an ink deposition volume calculation unit 106, and it specifies the data required in order to eject ink from the inkjet head 50.

The ink deposition data generation unit 104 generates the ink deposition data relating to ink droplet ejection from the inkjet head 50 onto the recording medium 16 that is required in order to form an image, on the basis of the image data and data relating to the operating mode, and the like, supplied by the image data reading unit 102. This ink deposition data includes, for example, information indicating "which nozzles to eject ink droplets from, and at what timing", and information indicating the voltage (voltage waveform) to be applied to the piezoelectric elements 59 of the inkjet head 50. The ink deposition data generation unit 104 according to the present embodiment generates the ink deposition data relating to each of divided regions set by dividing the print area of the recording medium 16 into a plurality of regions.

The ink deposition volume calculation unit 106 calculates the total ink volume to be deposited on the recording medium 16, on the basis of the ink deposition data created by the ink deposition data generation unit 104. In this, the ink deposition volume calculation unit 106 calculates the total ink volume for each divided region.

The ink head control unit 113 applies a prescribed voltage to the piezoelectric elements 59 of the inkjet head 50, on the basis of information, such as the ink deposition data and the total ink volume for each divided region specified in the ink ejection data specification unit 103. Accordingly, ink droplets are ejected from the inkjet head 50 toward the recording medium 16, thereby forming a desired image on the recording medium 16. In the present embodiment, a voltage of a single waveform is applied to the piezoelectric elements 59. Therefore, the number of ink droplets ejected onto the recording medium 16 is adjusted by means of the number of times a voltage is applied to the piezoelectric elements 59, and the ejection volume of the ink droplets is adjusted by the number of ink droplets ejected onto the recording medium 16.

The table storage unit 112 stores a prescribed ink-treatment liquid deposition volume table. This ink-treatment liquid deposition volume table is read in by the treatment liquid ejection data specification unit 107, and it is used when the volume of treatment liquid to be deposited onto the recording medium 16 is found in the treatment liquid ejection data specification unit 107. The ink-treatment liquid deposition volume table is described hereinafter (see FIG. 11).

The treatment liquid ejection data specification unit 107 comprises a treatment liquid deposition data generation unit 108 and a treatment liquid deposition volume calculation unit 110, and it specifies the data required in order to eject treatment liquid from the treatment liquid ejection head 11.

The treatment liquid deposition data generation unit 108 generates treatment liquid deposition data relating to the droplet ejection of treatment liquid onto the recording medium 16 from the treatment liquid ejection head 11, which is required in order to fix the coloring material of the ink onto the recording medium 16, on the basis of various types of data sent by the image data reading unit 102, the ink ejection data specification unit 103 and the treatment liquid deposition volume calculation unit 110. This treatment liquid deposition data includes, for example, information indicating "which nozzles to eject ink droplets from, and at what timing", and information indicating the voltage (voltage waveform) to be applied to the piezoelectric elements of the treatment liquid ejection head 11. The treatment liquid deposition data generation unit 108 generates treatment liquid deposition data relating to each of the divided regions of the print area of the recording medium 16.

The treatment liquid deposition volume calculation unit 110 calculates the total treatment liquid volume that should be deposited on the recording medium 16, on the basis of the "total ink volume to be deposited on the recording medium 16" as calculated by the ink deposition volume calculation unit 106, and the ink-treatment liquid deposition volume table stored in the table storage unit 112. In this, the treatment liquid deposition volume calculation unit 110 calculates the total treatment liquid volume for each divided region, on the basis of the total ink volume for each divided region.

The treatment liquid head control unit 114 applies voltage to the piezoelectric elements of the treatment liquid ejection head 11, on the basis of information, such as the treatment liquid deposition data and the total treatment liquid volume for each divided region specified by the treatment liquid ejection data specification unit 107. Consequently, treatment liquid is ejected from the treatment liquid ejection head 11 toward the recording medium 16, and a desired volume of treatment liquid is deposited onto a desired position of the recording medium 16. In the present embodiment, a voltage of a single waveform is applied to the piezoelectric elements of the treatment liquid ejection head 11. Therefore, the ejection volume of the treatment liquid is adjusted by adjusting the number of times a voltage is applied to the piezoelectric elements 59 and thus adjusting the number of droplets of treatment liquid ejected onto the recording medium 16.

In the present embodiment, each of the functional blocks shown in FIG. 10 is realized by either individual or collaborative action of the hardware components of the system control unit 100 shown in FIG. 9.

Figure 11:
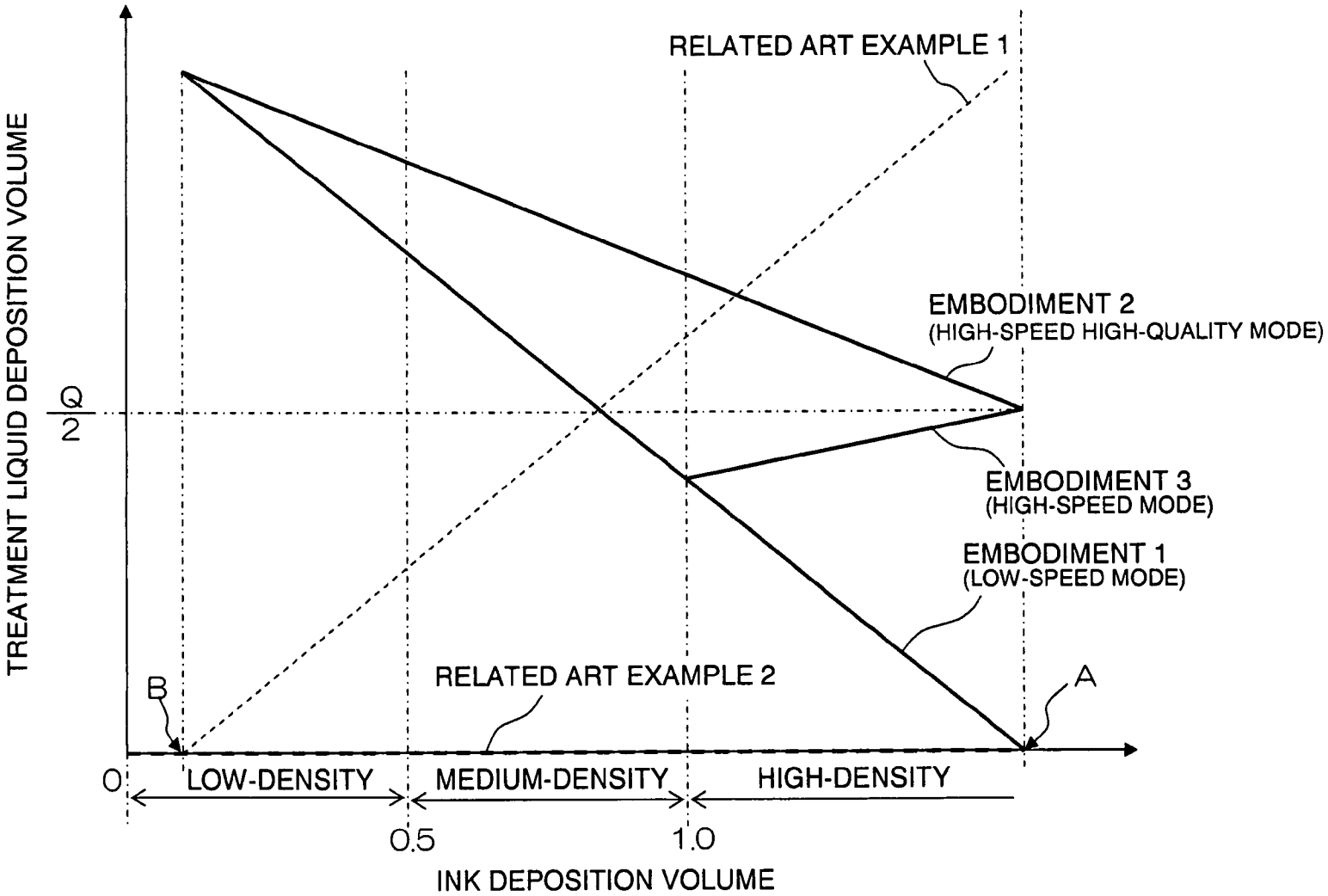
FIG. 11 is a diagram showing an embodiment of an ink-treatment liquid deposition volume table indicating the relationship between the ink deposition volume and the treatment liquid deposition volume.

FIG. 11 is a diagram showing an embodiment of an ink-treatment liquid deposition volume table indicating the relationship between the ink deposition volume and the treatment liquid deposition volume. In the present embodiment, the table indicated as "Embodiment 1" in FIG. 11 is used in particular. The ink deposition volume and the treatment liquid deposition volume shown in FIG. 11 refer to the divided regions of the recording medium 16. Furthermore, the density range based on the ink deposition volume is divided into three levels, in which the range of density from 0 to 0.5 inclusive is called a low density, the range of density greater than 0.5 and equal to or less than 1.0 is called a medium density, and the range of density greater than 1.0 is called a high density. Furthermore, FIG. 11 shows comparative embodiments, namely, a table indicated as "RELATED ART EXAMPLE 1", in which the ratio between the ink deposition volume and the treatment liquid deposition volume is substantially uniform, whatever the density, and a table indicated as "RELATED ART EXAMPLE 2", in which the treatment liquid deposition volume is substantially zero, regardless of the ink deposition volume. In the following description, a "low-density region" indicates a region on the recording medium 16 where the density is the low density, a "medium-density region" indicates a region on the recording medium 16 where the density is the medium density, and a "high-density region" indicates a region on the recording medium 16 where the density is the high density.

In the present embodiment, as shown in FIG. 11, the treatment liquid deposition volume decreases continuously and proportionately, in accordance with the ink deposition volume. For example, the treatment liquid deposition volume calculation unit 110 and the treatment liquid head control unit 114 control the treatment liquid ejection head 11 in such a manner that, in the high-density region where the ink deposition volume per prescribed unit of surface area on the recording medium 16 is high, the deposition volume of treatment liquid is equal to or less than half the maximum deposition volume Q of the ink, and furthermore, in a region on the recording medium 16 where the ink deposition volume is a maximum (see "A" in FIG. 11), the deposition volume of the treatment liquid is substantially zero. Furthermore, in cases of low density where the density is lower than a prescribed value (see "B" in FIG. 1), the deposition volume of the treatment liquid onto the recording medium 16 is also substantially zero.

In the present embodiment having the composition described above, the object liquid deposition device which deposits ink containing coloring material (the object liquid) onto the recording medium 16, is achieved by at least the inkjet head 50. Furthermore, the treatment liquid deposition device which deposits treatment liquid that insolubilizes the coloring material onto the recording medium is realized by at least the treatment liquid ejection head 11. Moreover, the control device which controls the treatment liquid deposition device is realized by at least the system control unit 100.

Next, the action of this embodiment is described below.

When an image is printed on a recording medium 16 by the inkjet recording apparatus 10 shown in FIG. 1, firstly, treatment liquid is ejected from the treatment liquid ejection head 11 onto the recording medium 16 as it is conveyed to the head. The recording medium 16 onto which treatment liquid has been deposited is then conveyed downstream, where it passes under the print unit 12. In this case, ink droplets are ejected from the heads of the print unit 12, thereby depositing ink onto the recording medium 16, and hence the treatment liquid previously deposited onto the recording medium 16, and the ink, mix together on the recording medium 16. Consequently, the coloring material component of the ink reacts with the treatment liquid and insolubilizes, and hence the coloring material component and the solvent component of the ink become separated, and the coloring material component is fixed effectively onto the recording medium 16. Thereupon, the recording medium 16 is conveyed to the post-drying unit 42, where the solvent component which has separated from the coloring material component is dried and removed. Accordingly, the coloring material component is fixed securely onto the recording medium 16, and a desired image is formed.

As described above, in the present embodiment, by mixing together ink and a treatment liquid on the recording medium 16, the fixing of the coloring material component of the ink onto the recording medium 16 is promoted effectively, and therefore, a vivid image is formed. The depositions of the ink and the treatment liquid onto the recording medium 16 is now described in more detail, with reference to FIG. 10 and FIGS. 13A and 13B.

Figure 12:
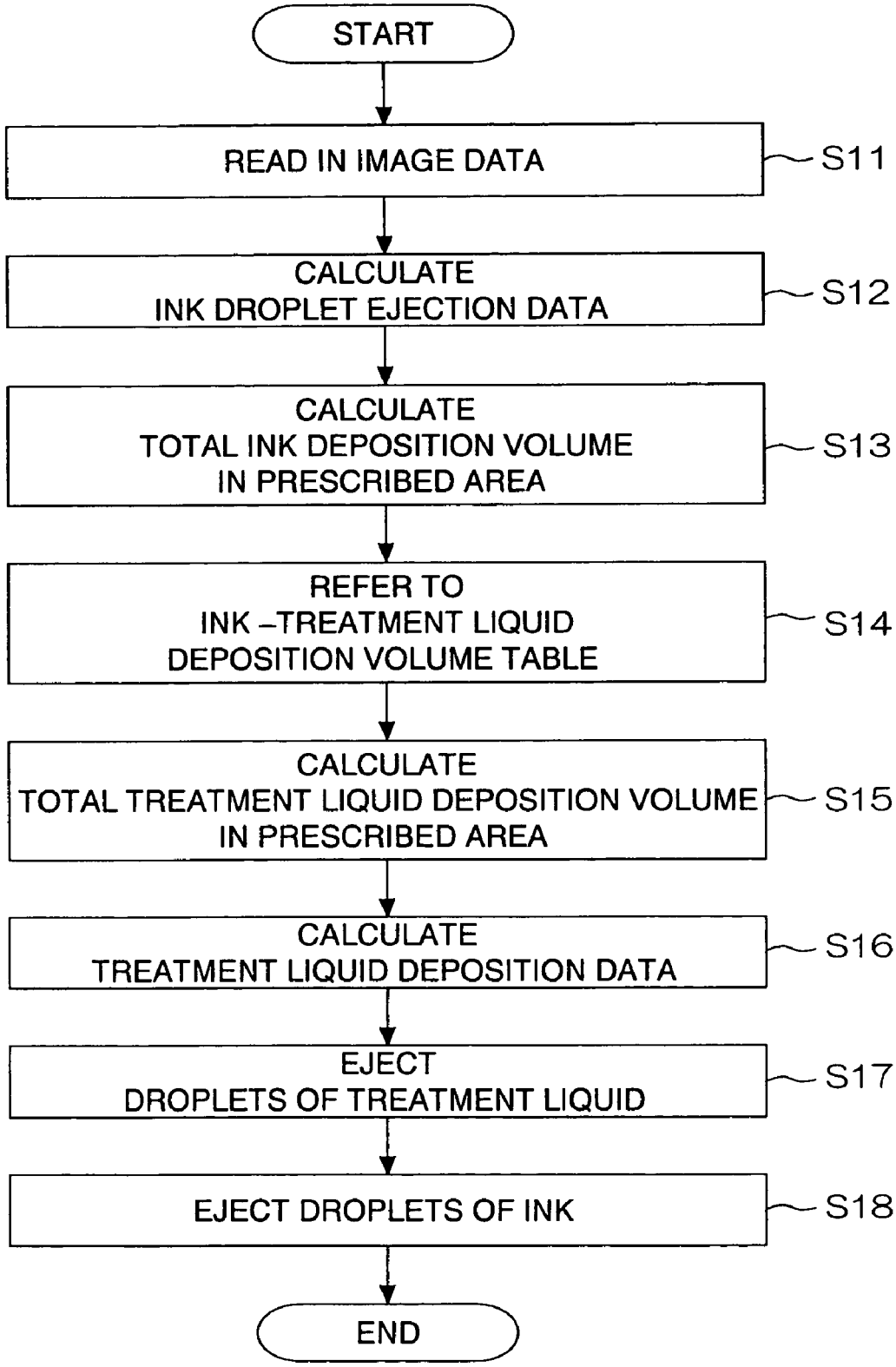
FIG. 12 is a flowchart showing a series of steps whereby ink and treatment liquid are deposited on a recording medium.

FIG. 12 is a flowchart showing a series of steps whereby ink and treatment liquid are deposited on the recording medium 16. Firstly, image data (print data) sent from the host computer 86 is read in by the image data reading unit 102 (S11 in FIG. 12), and it is sent to the ink ejection data specification unit 103. Ink deposition data relating to the ejection of ink droplets is generated by the ink deposition data generation unit. 104, on the basis of this image data (S12). The total ink deposition volume on the prescribed area of the divided regions on the recording medium 16 is calculated by the ink deposition volume calculation unit 106 on the basis of this ink deposition data (S13). On the other hand, the treatment liquid ejection data specification unit 107 refers to the ink-treatment liquid deposition volume table stored in the table storage unit 112 (S14). The treatment liquid deposition volume calculation unit 110 then calculates the total deposition volume of the treatment liquid for the prescribed area, on the basis of the ink-treatment liquid deposition volume table, and the total ink deposition volume for the prescribed area calculated by the ink ejection data specification unit 103 (S15). Furthermore, the treatment liquid deposition data is calculated by the treatment liquid deposition data generation unit 108, on the basis of information such as the total deposition volume of the treatment liquid for the prescribed area that has been derived in this way (S16).

The treatment liquid head control unit 114 then applies a voltage to the treatment liquid head control unit 114, on the basis of the treatment liquid total deposition volume and the treatment liquid deposition data thus calculated, and treatment liquid is ejected from the treatment liquid ejection head 11 toward the recording medium 16 (S17). In this, the piezoelectric elements of the treatment liquid ejection head 11 are controlled by the treatment liquid head control unit 114 in such a manner that the deposition volume of the treatment liquid in the high-density region of the recording medium 16 is less than the deposition volume of the treatment liquid in the low-density region. Furthermore, the piezoelectric elements of the treatment liquid ejection head 11 are controlled by the treatment liquid head control unit 114 in such a manner that the deposition volume of the treatment liquid in the medium-density region is between the deposition volume of the treatment liquid in the low-density region and the deposition volume of the treatment liquid in the high-density region.

After-treatment liquid has been deposited onto the recording medium 16, the ink head control unit 113 applies a voltage to the piezoelectric elements 59 of the inkjet head 50, on the basis of the calculated total ink deposition volume and ink droplet ejection data. Consequently, ink droplets are ejected from the respective inkjet heads 50, toward the recording medium 16 on which the treatment liquid has been deposited (S18), thereby forming a desired image.

Figure 13A:
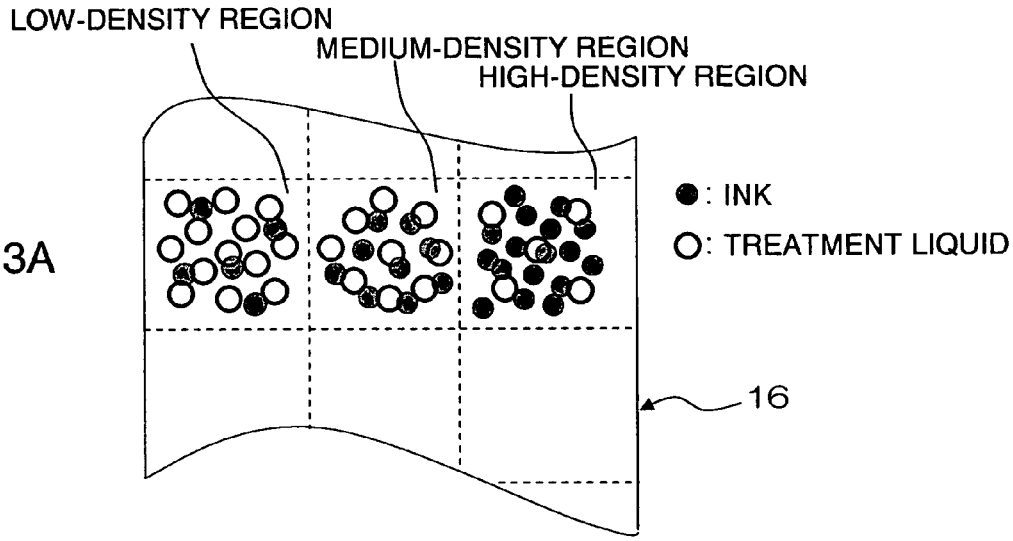
FIGS. 13A and 13B are diagrams showing one embodiment of the state of ink and treatment liquid on a recording medium.
Figure 13B:
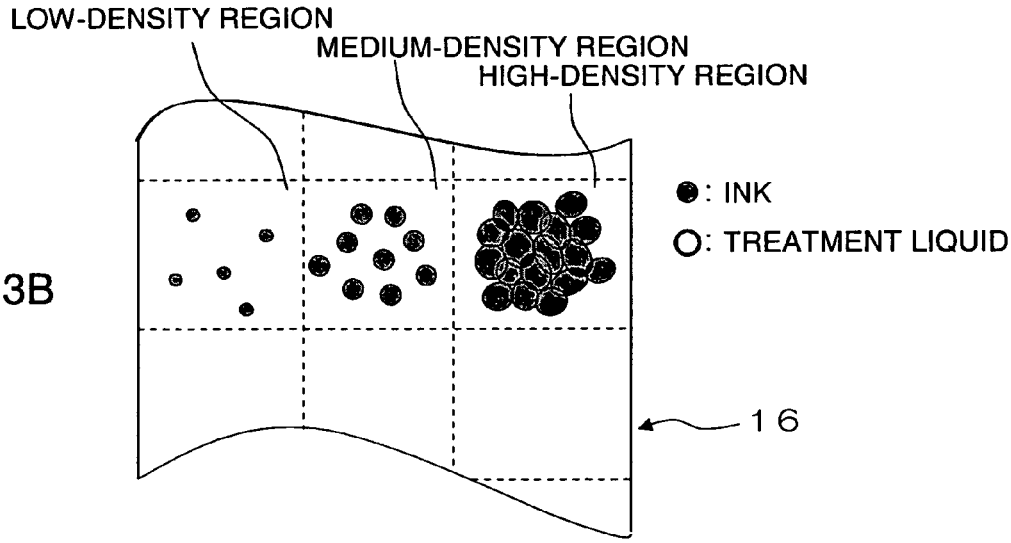

FIGS. 13A and 13B are diagrams showing one embodiment of the state of the ink and the treatment liquid on the recording medium 16. FIG. 13A shows a state immediately after the treatment liquid and ink have landed on the recording medium 16, and FIG. 13B shows a state when a prescribed time period has elapsed after the deposition of the treatment liquid and the ink on the recording medium 16. The regions surrounded by the dotted lines and the solid lines in the diagrams indicate unit regions of a prescribed size, and they are referred to when the image densities are determined. In the present embodiment, the ink volume per droplet is substantially the same, and the treatment liquid volume per droplet is also substantially the same. Therefore, in the present embodiment, the deposition volume of the treatment liquid is controlled by altering the number of droplets of the treatment liquid in accordance with the density regions on the recording medium 16.

As shown in FIG. 13A, in the present embodiment, the ink deposition volume (number of ink droplet ejections) increases sequentially on the recording medium 16, from the low-density region, to the medium-density region, to the high-density region; however, the deposition volume of treatment liquid (number of treatment liquid droplet ejections (droplets)) decreases. Consequently, in the low-density region where the ink deposition volume per unit region is low, the ink reacts with a sufficient volume of treatment liquid, and therefore the coloring material component in the ink is insolubilized and ultimately the dot diameter of the ink on the recording medium 16 is small (FIG. 13B). In the medium-density region or the high-density region, the ratio of the reactive volume of treatment liquid with respect to the ink decreases as the density increases, and therefore, the extent of the insolubilization of the coloring material component in the ink caused by the treatment liquid is weak, and the coloring material component disperses. Consequently, as shown in FIG. 13B, the ultimate diameter of the ink dots increases and the white surface color decreases accordingly, successively, from the low-density region, to the medium-density region, to the high-density region.

FIG. 14 is a diagram showing an evaluation of an image formed on a recording medium 16 by the inkjet recording apparatus 10. The evaluation in the first embodiment described above is listed in the "Embodiment 1" column in FIG. 14, and data relating to the "RELATED ART EXAMPLE 1" where the ratio of the ink deposition volume and the treatment liquid deposition volume is substantially uniform, and to the "RELATED ART EXAMPLE 2" where the treatment liquid deposition volume is substantially zero, regardless of the ink deposition volume (see FIG. 11), is also shown in FIG. 14. In FIG. 14, the "low-density region dot diameter" shows the dot diameter of the ink (and in particular, the coloring material) in a region of the low density on the recording medium 16, and the "high-density region dot diameter" shows the dot diameter of the ink (and in particular, the coloring material) in a region of the high density on the recording medium 16. Furthermore, the "low-density region granularity" indicates the image granularity in the region of the low density on the recording medium 16, and the "medium-density region granularity" indicates the image granularity in a region of the medium density on the recording medium 16. Moreover, the "density of the high-density region" indicates whether the image has sufficient uniform density in the high-density region on the recording medium 16. Furthermore, the "high-density region landing interference" indicates the extent of interference between mutually adjacent ink dots in the high-density region on the recording medium 16. In FIG. 14, "A" indicates an extremely good state, "B" indicates a good state, "C" indicates a normal state, and "F" indicates an inferior state compared to a normal state.

As shown in FIG. 14, in the first embodiment described above, it is possible to achieve a small dot diameter in the low-density region, in comparison with RELATED ART EXAMPLE 1 and RELATED ART EXAMPLE 2. This is because a sufficient volume of treatment liquid is deposited with respect to the ink deposition volume, in the low-density region on the recording medium 16 (see FIG. 11). Consequently, it is possible to achieve extremely good granularity in the low-density region, and a very clean image can be printed in the low-density region on the recording medium 16. Furthermore, in the first embodiment, it is possible to maintain a large dot diameter in the high-density region. This is because, in the high-density region on the recording medium 16, the insolubilization of the coloring material component of the ink is restricted, since only a small volume of treatment liquid is used, and therefore, the coloring material of the ink disperses (See FIGS. 13A and 13B). Consequently, it is possible to ensure extremely good density in the high-density region, and a clean image having sufficient color density can be printed in the high-density region.

In the present embodiment, it is possible to ensure a normal state in terms of the medium-density region granularity. On the other hand, since the volume of treatment liquid used in the high-density region on the recording medium 16 is restricted, then it is difficult to adequately prevent excessive dispersion of the coloring material of the ink on the recording medium 16. Therefore, the landing interference in the high-density region is inferior compared to a normal state.

According to the present embodiment described above, in the low-density region, a sufficient volume of treatment liquid is deposited in order to insolubilize the coloring material component of the ink effectively, whereas in the high-density region, treatment liquid of a level which effectively allows dispersion of the coloring material component in the ink is deposited. Therefore, in the low-density region, it is possible to achieve good image granularity by making the dot diameter of the ink (coloring material component) sufficiently small, whereas in the high-density region, it is possible effectively to prevent the occurrence of white background color by making the dot diameter of the ink (coloring material component) sufficiently large. In this way, the inkjet recording apparatus 10 according to the present embodiment is able to provide images with high quality in both the low-density region and the high-density region, by achieving dot diameters which are suited to the desired image density.

Second Embodiment

The present embodiment is substantially the same as the first embodiment described above, parts which are the same as those of the first embodiment being labeled with the same reference numerals and detailed description thereof being omitted here.

The table indicated by the label "Embodiment 2" in FIG. 11 is stored in the table storage unit 112 of the present embodiment as an ink-treatment liquid deposition volume table. According to this ink-treatment liquid deposition volume table, the treatment liquid deposition volume decreases proportionately in accordance with the ink deposition volume, and in the region of the recording medium 16 where the ink deposition volume is a maximum, the treatment liquid deposition volume is substantially one half of the maximum deposition volume Q of the ink. Therefore, the treatment liquid ejection data specification unit 107 and the treatment liquid head control unit 114 control the treatment liquid ejection head 11 in such a manner that, in the region of the recording medium 16 where the ink deposition volume is a maximum (see "A" in FIG. 11), the deposition volume of the treatment liquid is substantially one half of the maximum deposition volume Q of the ink.

The remaining composition is substantially the same as that of the first embodiment described above.

The evaluation of the image formed on the recording medium 16 by the inkjet recording apparatus 10 according to the present embodiment is shown in the "Embodiment 2" column in FIG. 14. As shown in FIG. 14, according to the present embodiment, both the medium-density region granularity and the high-density region landing interference are satisfactory (good). This is because the deposition volumes of treatment liquid in the medium-density region and the high-density region on the recording medium 16 are adjusted accordingly. In other words, in the present embodiment, even in the high-density region of the recording medium 16, treatment liquid of substantially half the volume of the maximum deposition volume Q of the ink is deposited, and hence the coloring material component of the ink mixing with the treatment liquid is insolubilized to a certain extent. Therefore, the dispersion of the ink coloring material component in the high-density region is suppressed to a certain extent, and interference between mutually adjacent ink dots is prevented. Consequently, the high-density region landing interference is satisfactory. However, the dispersion of the coloring material component of the ink in the high-density region is restricted to a certain extent. Therefore, although the density of the high-density region is maintained in a good state, it is slightly inferior in comparison with the case of the first embodiment (see "Embodiment 1"). On the other hand, in the medium-density region of the recording medium 16, since a large amount of treatment liquid is deposited in comparison with the first embodiment, then it is possible to suitably insolubilize the coloring material component of the ink in the medium-density region by means of the treatment liquid, and the granularity in the medium-density region can be improved.

As described above, according to the present embodiment, the total deposition volume of the treatment liquid is adjusted with respect to each density region, and a dot density suited to the desired image density is achieved. Therefore, a high-quality image is provided in both the low-density region and the high-density regions. Furthermore, good granularity of the image is ensured in the medium-density region, and landing interference between ink dots is prevented effectively in the high-density region. In this way, according to the present embodiment, good image quality is achieved, in the low-density region, the medium-density region and the high-density region.

Third Embodiment

The present embodiment is substantially the same as the first embodiment described above, parts which are the same as those of the first embodiment being labeled with the same reference numerals and detailed description thereof being omitted here.

The table indicated by the label "Embodiment 3" in FIG. 11 is stored in the table storage unit 112 of the present embodiment as an ink-treatment liquid deposition volume table. According to this ink-treatment liquid deposition volume table, in the low-density region and the medium-density region, similarly to the first embodiment described above, the treatment liquid deposition volume decreases proportionately with respect to the ink deposition volume. However, in the high-density region, the treatment liquid deposition volume increases proportionately with respect to the ink deposition volume, and in the region of the recording medium 16 where the ink deposition volume is a maximum, the treatment liquid deposition volume is substantially one half of the maximum deposition volume Q of the ink. Therefore, the treatment liquid ejection data specification unit 107 and the treatment liquid head control unit 114 control the treatment liquid ejection head 11 in such a manner that, in the region of the recording medium 16 where the ink deposition volume is a maximum (see "A" in FIG. 11), the deposition volume of the treatment liquid is substantially one half of the maximum deposition volume Q of the ink.

More specifically, the treatment liquid ejection data specification unit 107 divides the recording medium 16 into the low-density region, the medium-density region and the high-density region, in accordance with the ink deposition volume per prescribed unit of surface area. The treatment liquid ejection head 11 is then controlled by the treatment liquid ejection data specification unit 107 and the treatment liquid head control unit 114 in such a manner that the deposition volume of the treatment liquid in the medium-density region is less than the deposition volume of the treatment liquid in the low-density region. The treatment liquid ejection head 11 is then controlled by the treatment liquid ejection data specification unit 107 and the treatment liquid head control unit 114 in such a manner that the maximum deposition volume of the treatment liquid in the high-density region is greater than the minimum deposition volume of treatment liquid in the medium-density region and is less than the minimum deposition volume of the treatment liquid in the low-density region.

The remaining composition is substantially the same as that of the first embodiment described above.

The evaluation of the image formed on the recording medium 16 by the inkjet recording apparatus 10 according to the present embodiment is shown in the "Embodiment 3" column in FIG. 14. As shown in FIG. 14, according to the present embodiment, the landing interference in the high-density region is satisfactory. This is because, even in the high-density region of the recording medium 16, treatment liquid of substantially half the volume of the maximum deposition volume Q of the ink is deposited, and hence insolubilization of the coloring material component of the ink mixing with the treatment liquid progresses to a certain extent. Consequently, the dispersion of the ink coloring material component in the high-density region is suppressed to a certain extent, and interference between mutually adjacent ink dots is prevented. Therefore, the high-density region landing interference is satisfactory. However, the deposition volume of the treatment liquid in the medium-density region is the same as in the first embodiment, and therefore it is difficult to insolubilize the coloring material component of the ink effectively in the medium-density region. Therefore, in the third embodiment, similarly to the first embodiment, a normal level of granularity is achieved in the medium-density region.

As described above, in the present embodiment also, the total deposition volume of the treatment liquid is adjusted with respect to each density region, and a dot diameter suited to the desired image density is achieved. Therefore, a high-quality image is provided in both the low-density region and the high-density region. Furthermore, since the insolubilization of the coloring material component is promoted by the ink and the treatment liquid reacting together in the high-density region also, then it is possible to achieve satisfactory landing interference between ink dots in the high-density region.

Fourth Embodiment

The present embodiment is substantially the same as the first embodiment described above, parts which are the same as those of the first embodiment being labeled with the same reference numerals and detailed description thereof being omitted here.

Figure 15:
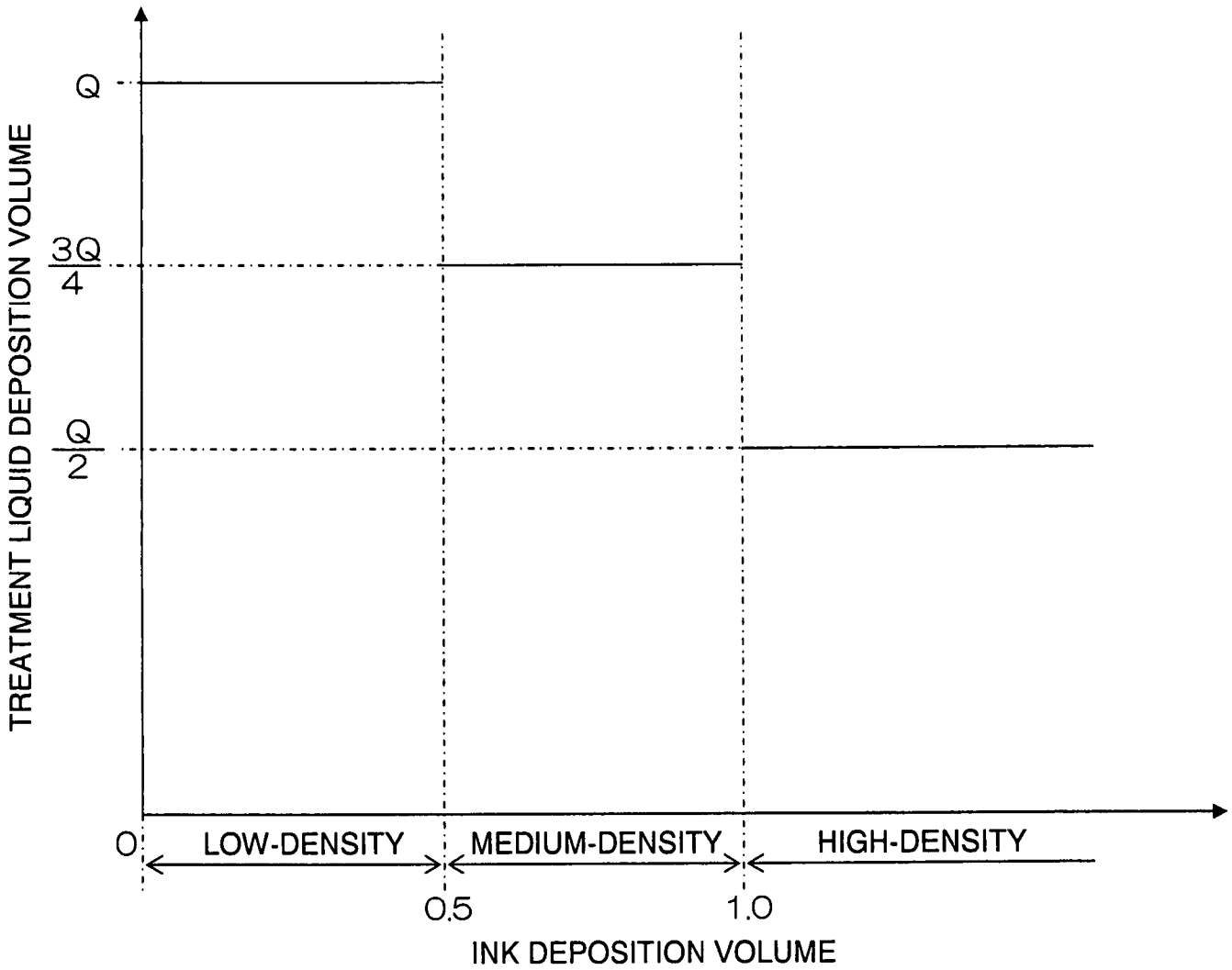
FIG. 15 is a diagram showing an ink-treatment liquid deposition volume table used in a fourth embodiment.

FIG. 15 is a diagram showing an ink-treatment liquid deposition volume table used in the fourth embodiment. The ink-treatment liquid deposition volume table shown in FIG. 15 is stored in the table storage unit 112 according to the present embodiment. According to this ink-treatment liquid deposition volume table, the deposition volume of the treatment liquid onto the recording medium 16 is adjusted in stages in accordance with differentiated density levels, namely, low density, medium density and high density, and it decreases gradually in stages in the order, the low density, to the medium density, to the high density. The deposition volume of the treatment liquid at the low density is substantially the same as the maximum volume Q of the ink that can be deposited onto the recording medium 16. Furthermore, the deposition volume of the treatment liquid at the high density is substantially one half of the maximum volume Q of the ink that can be deposited onto the recording medium 16. Furthermore, the deposition volume of the treatment liquid at the medium density is substantially three-quarters of the maximum volume Q of the ink that can be deposited onto the recording medium 16.

The remaining composition is substantially the same as that of the first embodiment described above.

The treatment liquid ejection data specification unit 107 of the system control unit 100 according to the present embodiment divide the print area of the recording medium 16 into a plurality of sectors, namely, the low-density region, the medium-density region and the high-density region, in accordance with the ink deposition volume per prescribed unit of surface area. The treatment liquid ejection data specification unit 107 refers to the ink-treatment liquid deposition volume table and calculates the total treatment liquid deposition volume and the treatment liquid deposition data in such a manner that the deposition volume of the treatment liquid onto the recording medium 16 is adjusted in steps, in accordance with the aforementioned sectors. The treatment liquid ejection head 11 is controlled by the treatment liquid head control unit 114 in such a manner that the deposition volume of the treatment liquid onto the recording medium 16 is adjusted in stages in accordance with the sectors.

In the present embodiment, a large volume of treatment liquid is deposited onto the recording media 16 in the low-density region, while a small volume of treatment liquid is deposited onto the high-density region. Therefore, dot diameters corresponding to the image densities are achieved, and high image quality is provided in both the low-density region and the high-density region. Furthermore, according to the present embodiment in particular, the deposition volume of the treatment liquid onto the recording medium 16 is adjusted in steps. Accordingly, it is not necessary to change the treatment liquid ejection control in a precise fashion, and therefore the control of the deposition of treatment liquid onto the recording medium 16 can be simplified.

Figure 16:
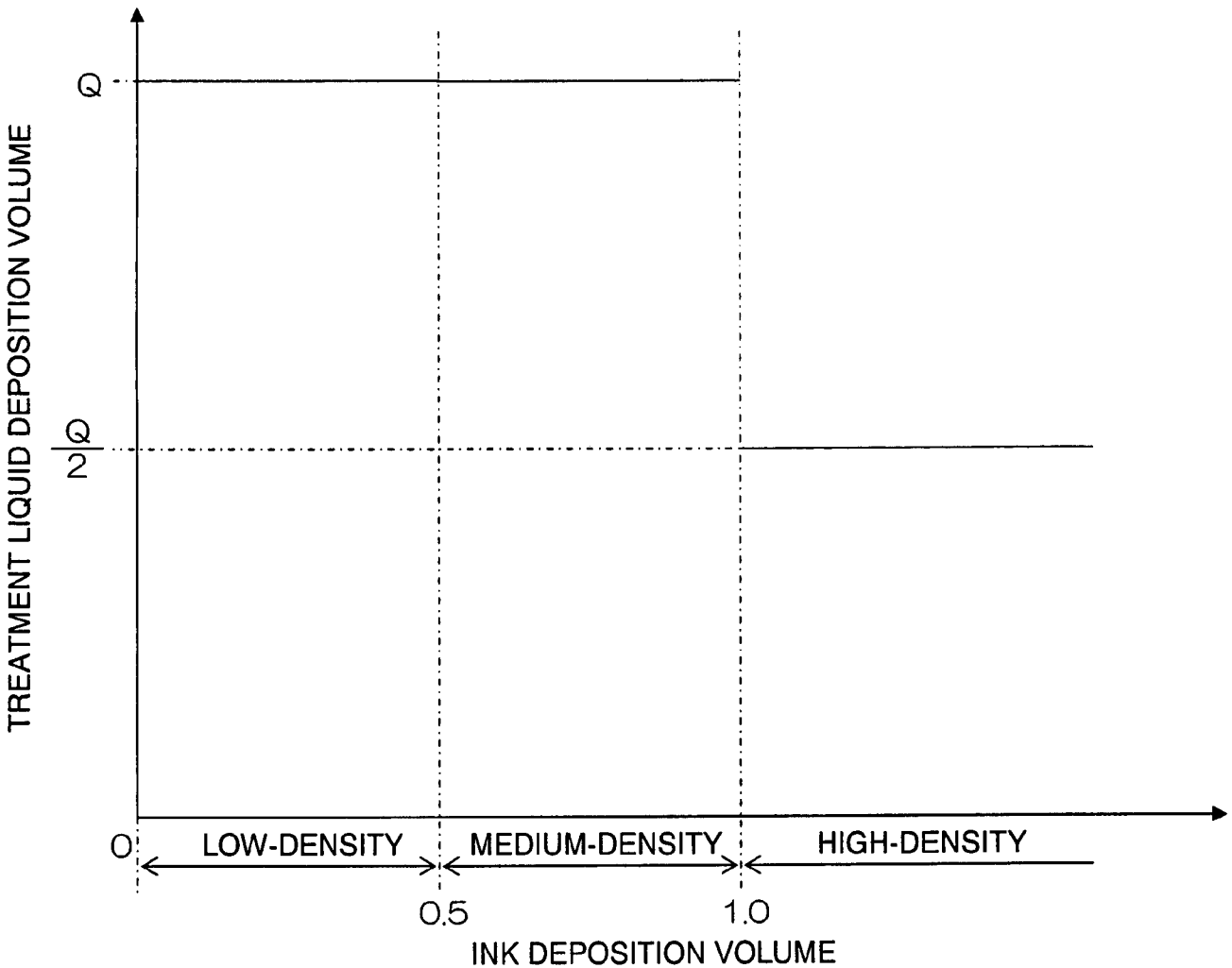
FIG. 16 is a diagram showing an ink-treatment liquid deposition volume table used in a first modification of the fourth embodiment.

Next, a first modification embodiment of the fourth embodiment is described below. FIG. 16 is a diagram showing an ink-treatment liquid deposition volume table used in the first modification of the fourth embodiment. In this modification embodiment, the ink-treatment liquid deposition volume table shown in FIG. 16 is stored in the table storage unit 112. According to this ink-treatment liquid deposition volume table, a relatively large volume of treatment liquid is deposited onto the low-density region and the medium-density region on the recording medium 16, and a relatively small volume of treatment liquid is deposited onto the high-density region. More specifically, in the low-density region and the medium-density region, treatment liquid of substantially the same volume as the maximum volume Q of the ink that can be deposited onto the recording medium 16 is deposited, and in the high-density region, treatment liquid of substantially one half of the maximum volume Q of the ink is deposited.

Consequently, in the low-density region and the medium-density region on the recording medium 16, the coloring material component of the ink is insolubilized by a sufficient volume of treatment liquid, and therefore, an image having excellent granularity is formed. Furthermore, in the high-density region, the insolubilization of the coloring material component of the ink by the treatment liquid, and the dispersion of the coloring material component of the ink are balanced, and an image which achieves high density and prevents landing interference between the dots is formed.

Figure 17:
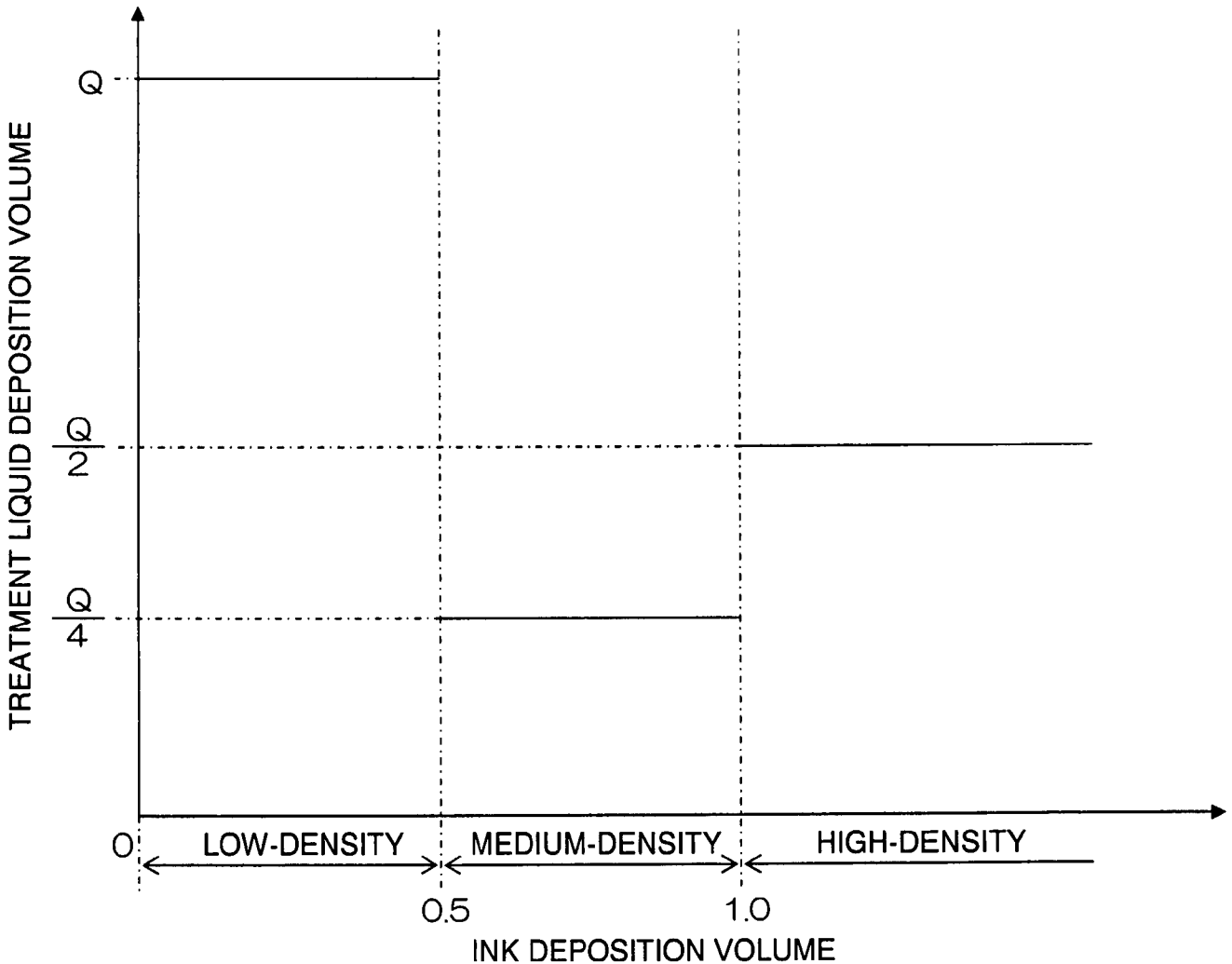
FIG. 17 is a diagram showing an ink-treatment liquid deposition volume table used in a second modification of the fourth embodiment.

Next, a second modification embodiment of the fourth embodiment is described below. FIG. 17 is a diagram showing an ink-treatment liquid deposition volume table used in the second modification of the fourth embodiment. In this modification, the ink-treatment liquid deposition volume table shown in FIG. 17 is stored in the table storage unit 112. According to this ink-treatment liquid deposition volume table, a relatively large volume of treatment liquid is deposited onto the low-density region on the recording medium 16, a relatively small volume of treatment liquid is deposited onto the medium-density region, and an intermediate volume of treatment liquid is deposited onto the high-density region. More specifically, in the low-density region, treatment liquid of substantially the same volume as the maximum volume Q of the ink that can be deposited onto the recording medium 16 is deposited, in the high-density region, treatment liquid of substantially one half of the maximum volume Q of the ink is deposited, and in the medium-density region, treatment liquid of substantially one quarter of the maximum volume Q of the ink is deposited.

Consequently, the treatment liquid ejection data specification unit 107 divides the print area of the recording medium 16 into the low-density region, the medium-density region and the high-density region, in accordance with the ink deposition volume per prescribed unit of surface area, and the treatment liquid ejection head 11 is controlled in such a manner that the deposition volume of treatment liquid in the medium-density region is lower than the deposition volume of treatment liquid in the low-density region. Furthermore, the treatment liquid ejection head 11 is controlled in such a manner that the deposition volume of treatment liquid in the high-density region is greater than the deposition volume of treatment liquid in the medium-density region and is less than the deposition volume of the treatment liquid in the low-density region.

Consequently, in the low-density region on the recording medium 16, the coloring material component of the ink is insolubilized by a sufficient volume of treatment liquid, and therefore, an image having excellent granularity is formed. Furthermore, in the medium-density region, since sufficient dispersion of the coloring material of the ink is guaranteed, then an image of sufficient density is formed. Moreover, in the high-density region, the insolubilization of the coloring material component of the ink by the treatment liquid, and the dispersion of the coloring material component of the ink are balanced, and an image which achieves high density and prevents landing interference between the dots is formed.

Fifth Embodiment

The first embodiment to the fourth embodiment are described above with respect to an embodiment where a single ink-treatment liquid deposition volume table is used, but it is also possible to selectively use a plurality of ink-treatment liquid deposition volume tables, according to the operational use. The present embodiment is described with respect to an embodiment in which the ink-treatment liquid deposition volume tables used in the first embodiment, the second embodiment and the third embodiment are used selectively on the basis of the operating mode.

The present embodiment is substantially the same as the first embodiment described above, parts which are the same as those of the first embodiment being labeled with the same reference numerals and detailed description thereof being omitted here.

Figure 18:
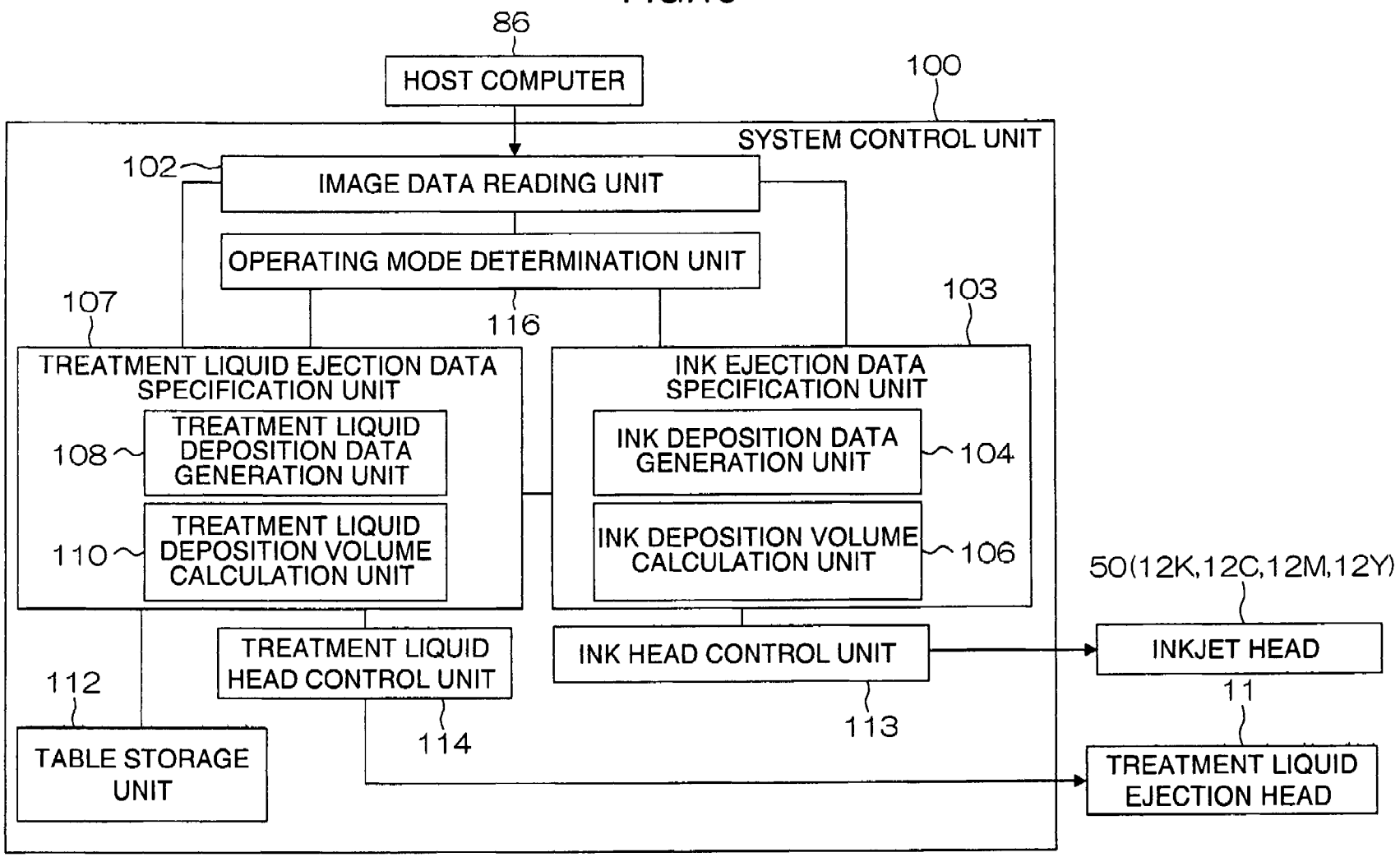
FIG. 18 is a block diagram showing the functional composition of a system control unit according to a fifth embodiment.

FIG. 18 is a block diagram showing the functional composition of a system control unit 100 according to the fifth embodiment, and in particular, it relates to the control of the inkjet head 50 and the treatment liquid ejection head 11. The system control unit 100 according to the present embodiment comprises an image data reading unit 102, an ink ejection data specification unit 103, a treatment liquid ejection data specification unit 107, a table storage unit 112, an ink head control unit 113, a treatment liquid head control unit 114, and, additionally, an operating mode determination unit 116.

The operating mode determination unit 116 determines the operating mode of the inkjet recording apparatus 10 on the basis of the data relating to the operating mode received from the host computer 86 via the image data reading unit 102. In the present embodiment, three operating modes are prepared, namely, a low-speed mode, a high-speed mode, and a high-speed high-quality mode.

The table storage unit 112 stores a plurality of ink-treatment liquid deposition volume tables, namely, the ink-treatment liquid deposition volume table used in the first embodiment described above (see "Embodiment 1" in FIG. 11), the ink-treatment liquid deposition volume table used in the second embodiment (see "Embodiment 2" in FIG. 11), and the ink-treatment liquid deposition volume table used in the third embodiment (see "Embodiment 3" in FIG. 11).

The treatment liquid deposition volume calculation unit 110 calculates the total treatment liquid volume that should be deposited on the recording medium 16, on the basis of the "total ink volume to be deposited on the recording medium 16" calculated by the ink deposition volume calculation unit 106 and the ink-treatment liquid deposition volume table stored in the table storage unit 112. In this, the treatment liquid ejection data specification unit 107 specifies the ink-treatment liquid deposition volume table to be used in the calculation of the total treatment liquid volume, in accordance with the operating mode determined by the operating mode determination unit 116. In the present embodiment, if the operating mode is the low-speed mode, for example, then the ink-treatment liquid deposition volume table indicated by "Embodiment 1" in FIG. 11 is selected, if the operating mode is the high-speed high-quality mode, then the ink-treatment liquid deposition volume table indicated by "Embodiment 2" is selected, and if the operating mode is the high-speed mode, then the ink-treatment liquid deposition volume table indicated by "Embodiment 3" is selected.

The remaining composition is substantially the same as that of the first embodiment described above.

Figure 19:
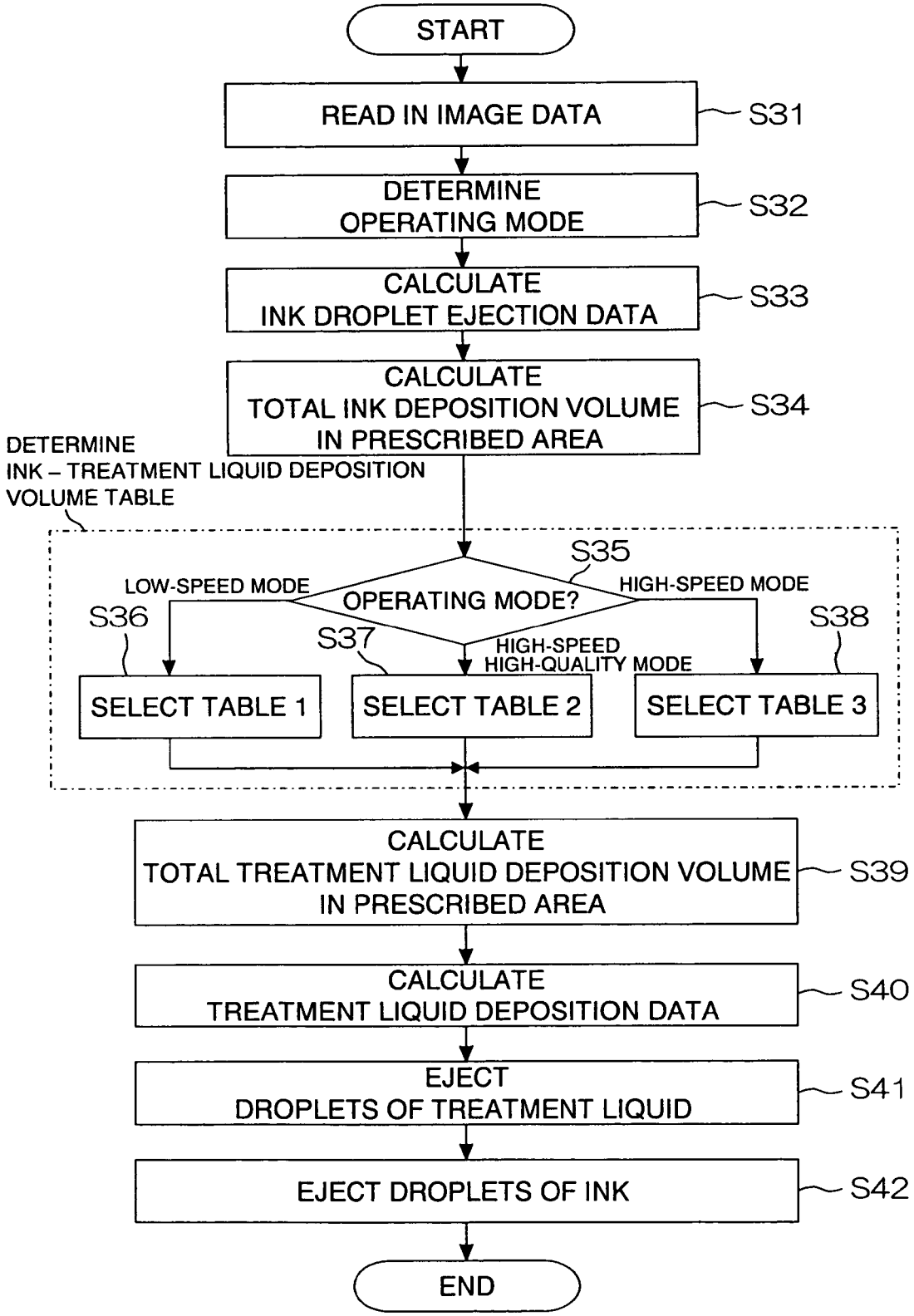
FIG. 19 is a flowchart showing a series of steps whereby ink and treatment liquid are deposited on a recording medium in the fifth embodiment.

FIG. 19 is a flowchart showing a series of steps whereby ink and treatment liquid are deposited on the recording medium 16 in the fifth embodiment. Firstly, image data (print data) supplied by the host computer 86 is read in by the image data reading unit 102 (S31 in FIG. 19). The operating mode determination unit 116 then determines the operating mode of the inkjet recording apparatus 10 on the basis of the image data thus read in (S32).

On the other hand, in the ink ejection data specification unit 103, the ink deposition data is calculated by the ink deposition data generation unit 104, on the basis of the image data and the operating mode read by the image data reading unit 102 (S33). The total ink deposition volume on the prescribed area of the divided regions on the recording medium 16 is calculated by the ink deposition volume calculation unit 106 on the basis of this ink deposition data (S34).

Furthermore, the treatment liquid ejection data specification unit 107 specifies which table should be selected from the ink-treatment liquid deposition volume tables stored in the table storage unit 112, on the basis of the determination results for the operating mode determined by the operating mode determination unit 116 (S35). If the determined operating mode is the "low-speed mode", for example, then the ink-treatment liquid deposition volume table for the low-speed mode is selected (see "Embodiment 1" in FIG. 11) (S36). Furthermore, if the determined operating mode is the "high-speed high-quality mode", then the ink-treatment liquid deposition volume table for the high-speed high-quality mode is selected (see "Embodiment 2" in FIG. 11) (S37). Furthermore, if the determined operating mode is the "high-speed mode", then the ink-treatment liquid deposition volume table for the high-speed mode is selected (see "Embodiment 3" in FIG. 11) (S38).

The treatment liquid deposition volume calculation unit 110 then refers to the selected ink-treatment liquid deposition volume table, and calculates the total deposition volume of the treatment liquid for the prescribed area, on the basis of the ink-treatment liquid deposition volume table and the total ink deposition volume for the prescribed area calculated by the ink deposition volume specification unit 106 (S39). Furthermore, the treatment liquid deposition data is calculated by the treatment liquid deposition data generation unit 108, on the basis of the total deposition volume of the treatment liquid for the prescribed area, which has been derived in this way (S40).

The treatment liquid head control unit 114 then applies a voltage to piezoelectric elements of the treatment liquid head 11, on the basis of the treatment liquid total deposition volume and the treatment liquid deposition data thus calculated, and treatment liquid is ejected from the treatment liquid ejection head 11 toward the recording medium 16 (S41). Thereupon, the ink head control unit 113 applies a voltage to the piezoelectric elements 59 of the inkjet heads 50 on the basis of the calculated total ink deposition volume and ink droplet ejection data, and ink is ejected from the inkjet heads 50 toward the recording medium 16 to which treatment liquid has already been applied (S42). In this way, the treatment liquid and the ink are deposited suitably onto desired positions on the recording medium 16, and a desired image is formed.

In this way, according to the present embodiment, a plurality of ink-treatment liquid deposition volume tables are used selectively, in accordance with the operating mode selected by the user. Therefore, it is possible to achieve printing that can adapt flexibly to the user's needs.

The present invention is not limited to the embodiments described above or modifications thereof, and it may also be changed in terms of various design modifications, and the like, on the basis of the knowledge of a person skilled in the art, and embodiments incorporating such modifications also can be included in the scope of the present invention.

For example, in the embodiments described above, one treatment liquid ejection head 11 is positioned on the upstream side of the print unit 12 (see FIG. 1), but the positioning of the treatment liquid ejection head is not limited to this. For example, it is also possible to dispose at least one treatment liquid ejection head 11 in at least one position between the heads of the print unit 12, or to position treatment liquid ejection heads 11 corresponding to heads of the print unit 12 respectively.

Furthermore, the device for depositing treatment liquid on the recording medium is not limited to an ejection head based on an inkjet system as described above, and a roller, brush, blade or other member may be used instead of, or in conjunction with, such an ejection head.

Moreover, in the respective embodiments described above, a full line type of head is used, but it is possible to use other types of head. For example, it is also possible to record images by moving a short recording head, such as a shuttle head, back and forth reciprocally.

Additionally, in the above description of the first embodiment, an embodiment where the deposition volume of the treatment liquid onto the recording medium 16 is controlled by means of the "number of droplet ejections (i.e., number of droplets)" from the treatment liquid ejection head 11 is described (see FIGS. 13A and 13B), but it is not limited to this. For example, it is possible to control the deposition volume of the treatment liquid onto the recording medium 16 on the basis of the ejection volume per droplet, or the thickness of the treatment liquid deposited onto the recording medium 16, or the like.

Figure 20:
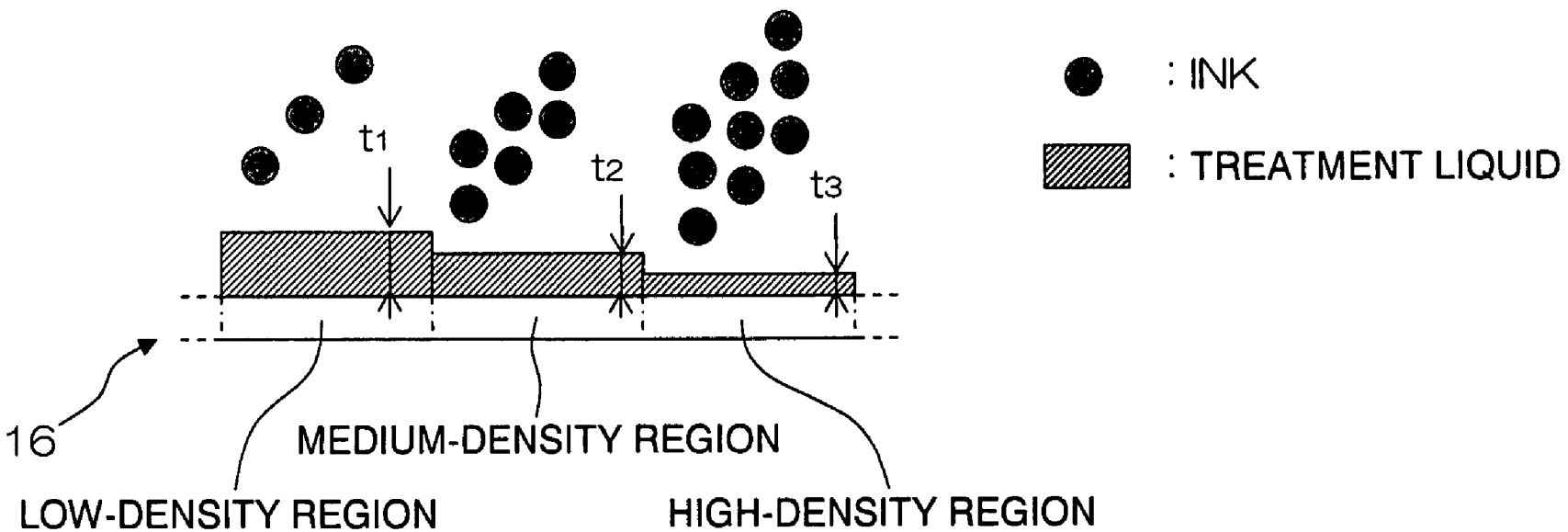
FIG. 20 is a diagram showing an embodiment where the deposition volume of the treatment liquid onto the recording medium is controlled on the basis of the thickness of the treatment liquid deposited onto the recording medium.

FIG. 20 is a diagram showing an embodiment where the deposition volume of the treatment liquid onto the recording medium 16 is controlled on the basis of the thickness of the treatment liquid deposited onto the recording medium 16. In the embodiment shown in FIG. 20, the thickness of the treatment liquid is controlled by the system control unit 100 in such a manner that the thickness of the treatment liquid becomes gradually thinner, successively, from the thickness $t_1$ of the treatment liquid in the low-density region, to the thickness $t_2$ of the treatment liquid in the medium-density region, to the thickness $t_3$ of the treatment liquid in the high-density region (namely, $t_1>t_2>t_3$). Consequently, the deposition volume of treatment liquid in the high-density region is less than the deposition volume of treatment liquid in the low-density region, and similar actions and beneficial effects to those of the first embodiment described above are obtained. The thickness of the treatment liquid on the recording medium 16 can be controlled by any desired method. For example, if the treatment liquid is applied to the recording medium 16 by a split roller or a brush, then it is possible to control the thickness of the treatment liquid on the recording medium 16 by adjusting the volume of treatment liquid contained in the split roller, or the like, or by adjusting the pressing force against the recording medium 16, or the like.

Moreover, if the deposition volume of treatment liquid onto the recording medium 16 is controlled by altering the ejection volume of treatment liquid per droplet ejected from the treatment liquid ejection head 11, then it is necessary, for instance, to alter the voltage (voltage waveform) applied to the piezoelectric elements of the treatment liquid ejection head 11.

Furthermore, the various embodiments described above related to embodiments where the print area of the recording medium 16 is divided into three regions, namely, a low-density region, a medium-density region and a high-density region, but the invention is not limited to this. The present invention can be applied to any case where the print area of the recording medium 16 is divided into two or more regions (desirably, not less than three regions) in accordance with the density. Furthermore, if the print area of the recording medium 16 is divided on the basis of the density, then the densities forming the reference for division are not limited to those of the embodiments described above, and the print area may be divided into a plurality of regions on the basis of suitable densities according to the use conditions or other factors.

Specific Examples of Treatment Liquid and Ink

In the embodiments described above, it is possible to use, as a treatment liquid, an aqueous solution, for example, containing at least the following substances:

| | |
|---|---|
| Sharol DC-902P, manufactured by Dai-Ichi Kogyo Seiyaku Co., Ltd.: | 1 to 20 wt% (weight percentage); and |
| Olfine E1010 (as surface-active agent), manufactured by Nissin Chemical Industry Co., Ltd.: | 0.05 to 0.1 wt%. |

The following substances can be added to this aqueous solution:

| | |
|---|---|
| glycerol (as a high-boiling-point solvent): | 0 to 30 wt %; and |
| triethanolamine (as a pH adjuster): | 0 to 10 wt %. |

On the other hand, it is possible to use, as an ink containing a coloring material, an aqueous solution, for example, containing at least the following substances:

| | |
|---|---|
| Anionic dye compounds having, for example, the following general chemical formulas: | 1 to 30 wt %; |

(M-1)

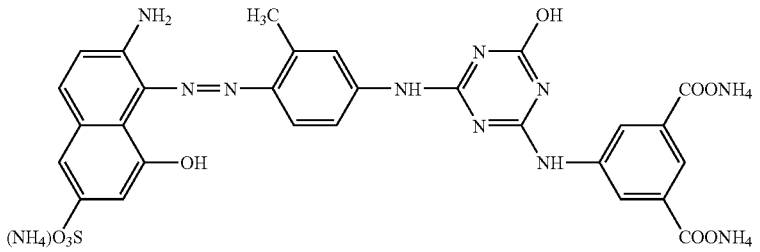

(M-2)

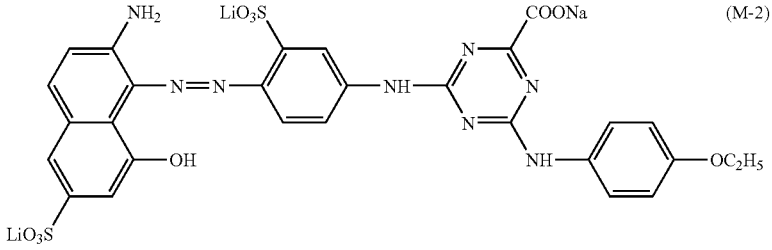

(M-3)

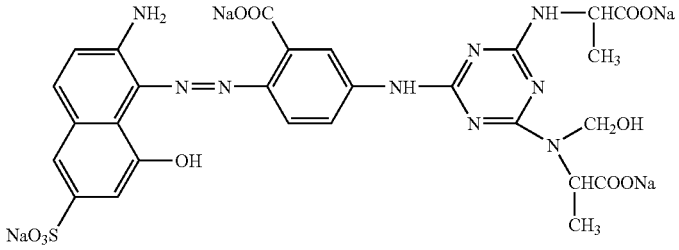

| | |
|---|---|
| Olfine E1010 (as surface-active agent), manufactured by Nissin Chemical Industry Co., Ltd.: | 0.1 to 10 wt %. |

The following substances can be added to this aqueous solution:

| | |
|---|---|
| polystyrene sodium sulfonate | 0 to 20 wt %; |
| glycerol (as a high-boiling-point solvent): | 0 to 30 wt %; and |
| triethanolamine (as a pH adjuster): | 0 to 10 wt %. |

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

an ink containing coloring material;

an ink deposition device which deposits the ink containing coloring material onto a region of a recording medium;

a treatment liquid that insolubilizes the coloring material;

a treatment liquid deposition device which deposits the treatment liquid that insolubilizes the coloring material onto the recording medium;

the region of the recording medium including a surface area for a plurality of adjacent ink droplets; and a control device divides the recording medium into a plurality of sectors, including a low-density region, a high-density region, and a medium-density region between the low-density region and the high-density region, in accordance with the volume per prescribed surface area of the ink deposited on the recording medium; and the control device controls the treatment liquid deposition device in such a manner that volume of the treatment liquid deposited in the medium-density region is less than the volume of the treatment liquid deposited in the low-density region, and the volume of the treatment liquid deposited in the high-density region is greater than the volume of the treatment liquid deposited in the medium-density region and less than the volume of the treatment liquid deposited in the low-density region.

2. The image forming apparatus as defined in claim 1, wherein the control device divides the recording medium into a plurality of sectors in accordance with the volume per prescribed surface area of the ink deposited on the recording medium, and controls the treatment liquid deposition device in such a manner that volume of the treatment liquid on the recording medium is adjusted in stages in accordance with the sectors.

3. The image forming apparatus as defined in claim 1, wherein the control device controls the treatment liquid deposition device in such a manner that, in a region on the recording medium where the ink having a maximum volume is deposited, the treatment liquid having a volume which is not greater than half of the maximum volume of the ink is deposited.

4. The image forming apparatus as defined in claim 1, wherein the control device controls the treatment liquid deposition device in such a manner that, in a region on the recording medium where the ink having a maximum volume is deposited, the treatment liquid having a volume which is approximately half of the maximum volume of the ink is deposited.

5. The image forming apparatus as defined in claim 1, wherein the control device controls the treatment liquid deposition device according to operating modes of the image forming apparatus.

6. An image forming method, comprising the steps of:

dividing a recording medium into a plurality of sectors, including a low-density region, a high-density region, and a medium-density region between the low-density region and the high-density region, in accordance with the volume per prescribed surface area of ink deposited on the recording medium;

depositing an ink containing coloring material onto a region of a recording medium, the region of the recording medium including a surface area for a plurality of adjacent ink droplets; and depositing a treatment liquid which insolubilizes the coloring material onto the recording medium, wherein volume of the treatment liquid deposited in the medium-density region is less than the volume of the treatment liquid deposited in the low-density region, and the volume of the treatment liquid deposited in the high-density region is greater than the volume of the treatment liquid deposited in the medium-density region and less than the volume of the treatment liquid deposited in the low-density region.

7. The image forming method as defined in claim 6, wherein the volume of the treatment liquid is controlled according to operating modes.

* * * * *